US006338581B1

(12) United States Patent
Takatsuka et al.

(10) Patent No.: US 6,338,581 B1
(45) Date of Patent: Jan. 15, 2002

(54) IMAGE FORMING DEVICE

(75) Inventors: Tsutomu Takatsuka; Kazuo Sanada; Seiichi Inoue, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/505,200

(22) Filed: Feb. 16, 2000

(30) Foreign Application Priority Data

Feb. 16, 1999 (JP) ..... 11-037749
Jan. 18, 2000 (JP) ..... 12-008859

(51) Int. Cl.[7] ..... G03D 5/00
(52) U.S. Cl. ..... 396/604; 396/627
(58) Field of Search ..... 396/604, 627; 430/405

(56) References Cited

U.S. PATENT DOCUMENTS 5,960,224 A * 9/1999 Sanada et al. ..... 396/604
6,001,544 A * 12/1999 Makuta et al. ..... 430/405
6,159,668 A * 12/2000 Mukata ..... 430/405

FOREIGN PATENT DOCUMENTS

EP 909041 * 3/1999 ..... 396/FOR 942

* cited by examiner

*Primary Examiner*—D. Rutledge
(74) *Attorney, Agent, or Firm*—Sughrue Mion, PLLC

(57) ABSTRACT

An image forming device which, after exposing a silver halide photographic photosensitive material, subjects the silver halide photographic photosensitive material to at least developing and bleaching-fixing processings so as to form an image on the silver halide photographic photosensitive material. The silver halide photographic photosensitive material has, on a support, one or more photographic structural layers. At least one of the photographic structural layers contains at least one color developing agent and at least one dye forming coupler. The image forming device includes a processing solution applying device which applies a processing solution for developing onto only a surface of the silver halide photographic photosensitive material at which surface the one or more photographic structural layers are provided.

10 Claims, 12 Drawing Sheets

IMAGE FORMING DEVICE

BACKGROUND OF THE INVENTION

1. Field of the Invention

The present invention relates to an image forming device in which processing solutions are appropriately applied to an image recording material such as a photosensitive material to form an image.

2. Description of the Related Art

Conventionally, when copying a color film original or a color printed original onto an image recording material such as a silver halide photographic photosensitive material, the photosensitive material is subjected to various processings such as exposure, developing, bleaching-fixing, washing and drying in that order.

During developing, bleaching-fixing and washing, the photosensitive material is successively immersed in a developing solution, a bleaching solution and washing water, which are processing solutions held in a developing tank, a bleaching-fixing tank, and a washing tank, respectively. In this way, the developing solution, the bleaching solution and the washing water are applied to the photosensitive material.

When a photosensitive material is immersed in and processed in a tank which holds processing solution, the processing solution is applied to the entire front and reverse surfaces of the photosensitive material, and a large amount of processing solution is required. Further, the processing solution becomes exhausted due to the processing, and becomes exhausted due to the processing solution oxidizing by contacting the air. If a large amount of photosensitive materials is processed continuously, an amount of processing solution corresponding to the exhausted amount will have to be replenished. Thus, in a system in which processing is carried out by a photosensitive material being immersed in a processing solution within a processing tank, problems arise in that a large amount of waste solution is generated, and processing to dispose of the processing solution is required.

SUMMARY OF THE INVENTION

In view of the aforementioned, an object of the present invention is to provide an image forming device in which respective processings can be carried out by applying small amounts of processing solutions, and in which processing of waste solution is not necessary.

The first aspect of the present invention is an image forming device which, after exposing a silver halide photographic photosensitive material, subjects the silver halide photographic photosensitive material to at least developing and bleaching-fixing processings so as to form an image on the silver halide photographic photosensitive material, the silver halide photographic photosensitive material having, on a support, one or more photographic structural layers, at least one of the photographic structural layers containing at least one color developing agent and at least one dye forming coupler, the image forming device comprising: a processing solution applying device which applies a processing solution for developing onto only a surface of the silver halide photographic photosensitive material at which surface the one or more photographic structural layers are provided.

The second aspect of the present invention is an image forming device which, after exposing a silver halide photographic photosensitive material, subjects the silver halide photographic photosensitive material to at least developing and bleaching-fixing processings so as to form an image on the silver halide photographic photosensitive material, the silver halide photographic photosensitive material having, on a support, one or more photographic structural layers, at least one of the photographic structural layers containing at least one color developing agent and at least one dye forming coupler, the image forming device comprising: a processing solution applying device which applies a processing solution for bleaching-fixing onto only a surface of the silver halide photographic photosensitive material at which surface the one or more photographic structural layers are provided.

The third aspect of the present invention is an image forming device which forms an image on a silver halide photographic photosensitive material which has, on a support, one or more photographic structural layers, at least one of the photographic structural layers containing at least one color developing agent and at least one dye forming coupler, the image forming device comprising: a processing solution applying device which applies a processing solution for developing onto only a surface of the silver halide photographic photosensitive material at which surface the one or more photographic structural layers are provided; a processing solution applying device which applies a processing solution for bleaching-fixing onto only the surface of the silver halide photographic photosensitive material at which surface the one or more photographic structural layers are provided; and a processing solution applying device which applies a processing solution for an after-processing onto only the surface of the silver halide photographic photosensitive material at which surface the one or more photographic structural layers are provided.

In the image forming device of the present invention, it is preferable that the processing solution for developing, which is applied onto only the surface of the silver halide photographic photosensitive material at which surface the one or more photographic structural layers are provided, is an alkaline activating solution.

In accordance with the above-described structure, in any of the developing processing, bleaching-fixing processing and after-processing carried out on the silver halide photographic photosensitive material, the processing solution applying device applies the processing solution used in that step onto only the surface of the silver halide photographic photosensitive material at which surface the one or more photographic structural layers are provided, such that the processing is carried out.

In this way, processing can be carried out by applying the required processing solution onto only the surface of the silver halide photographic photosensitive material at which surface the one or more photographic structural layers are provided. Therefore, it is not necessary to apply processing solution to portions of the silver halide photographic photosensitive material at which the processing solution is not needed. Thus, it is possible to use less processing solution. Moreover, there is no need to squeeze out the excess processing solution and then dry the photographic photosensitive material. There is no need for the image forming device, which subjects silver halide photographic photosensitive materials to developing processing, to utilize a large amount of processing solution. Thus, maintenance is facilitated, and stable developing processing can be carried out. In addition, the image forming device can be made more compact on the whole.

In the image forming device of the present invention, preferably, an amount of the processing solution, which is applied onto only the surface of the silver halide photographic photosensitive material at which surface the one or more photographic structural layers are provided, is an amount which is used up for the processing.

In accordance with this structure, in addition to the above-described operation and effects, in the image forming device of the present invention, the processing solution applying device applies the minimum required amount of processing solution, and all of the processing solution can be used up. Waste solution which has deteriorated due to repeated use is not generated, and there is no need to process waste solution.

In the image forming device of the present invention, preferably, the processing solution applying device has a plurality of nozzle holes, and the processing solution is sprayed simultaneously from the plurality of nozzle holes to be applied to the silver halide photographic photosensitive material.

In accordance with this structure, as additional operation and effects of the present invention, the processing solution applying device having the plural nozzle holes sprays the processing solution simultaneously from the nozzle holes. The processing solution is applied onto only the surface of the exposed silver halide photographic photosensitive material at which surface the one or more photographic structural layers are provided, such that processing for forming an image on the photosensitive material is carried out.

Further, because the processing solution applying device has a plurality of nozzle holes, the many drops of processing solution are sprayed so as to be applied uniformly onto the photographic photosensitive material.

The processing solution applying device sprays processing solution simultaneously from the nozzle holes. Thus, the processing solution can be applied to a large area by a single spraying, and the time required for application of the processing solution can be reduced.

In the image forming device of the present invention, preferably, the processing solution applying device has a plurality of nozzle holes which are arranged so as to be distributed along an entire transverse direction width of the silver halide photographic photosensitive material, the nozzle holes and the silver halide photographic photosensitive material are moved relative to one another, and the processing solution is sprayed from the plurality of nozzle holes to be applied to the photosensitive material.

In accordance with this structure, in addition to the operation and effects described above, because the processing solution applying device has a plurality of nozzle holes which are arranged so as to be distributed along the entire transverse direction width of the photosensitive material, the processing solution can be applied over the entire transverse direction width of the photosensitive material by a single spraying.

DESCRIPTION OF THE PREFERRED EMBODIMENTS

Figure 1:
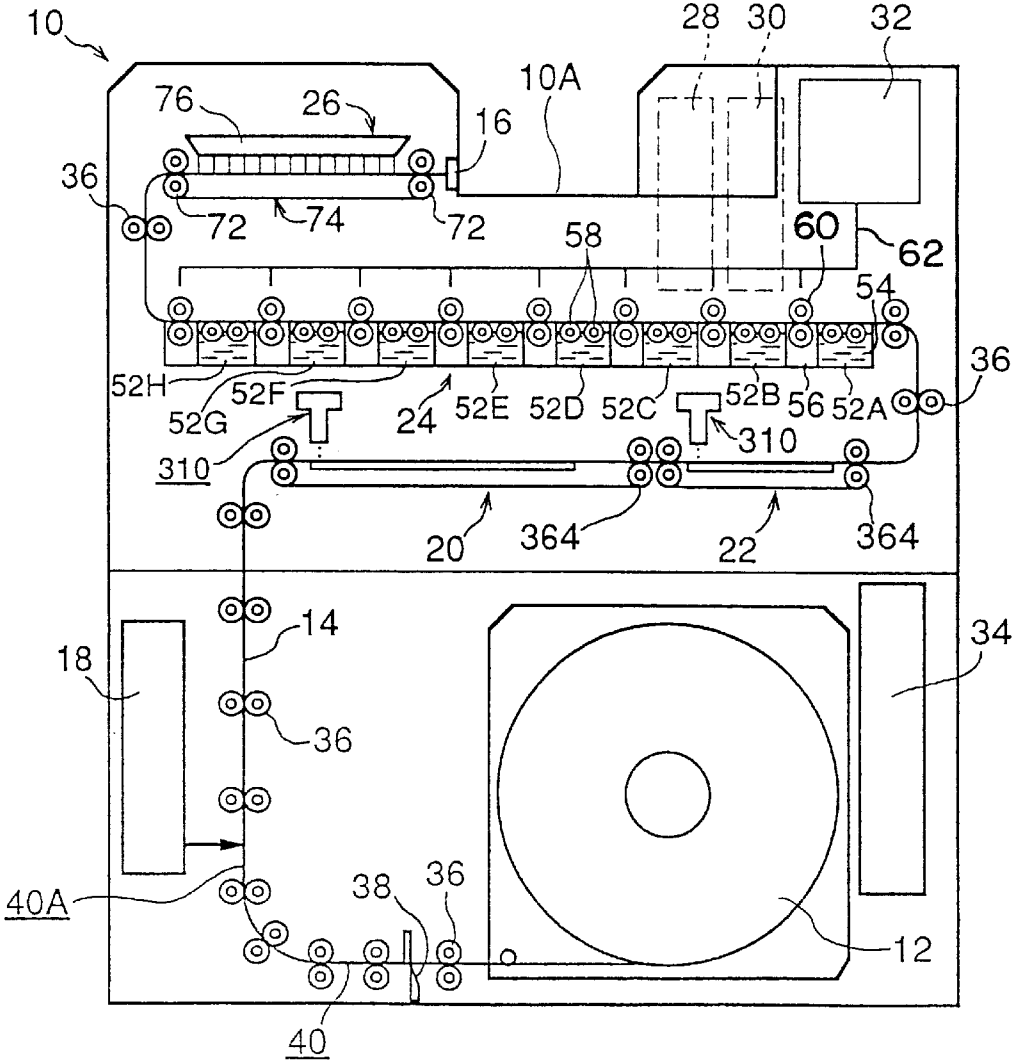
FIG. 1 is a front view illustrating a schematic structure of an entire image forming device relating to an embodiment of the present invention.
Figure 2:
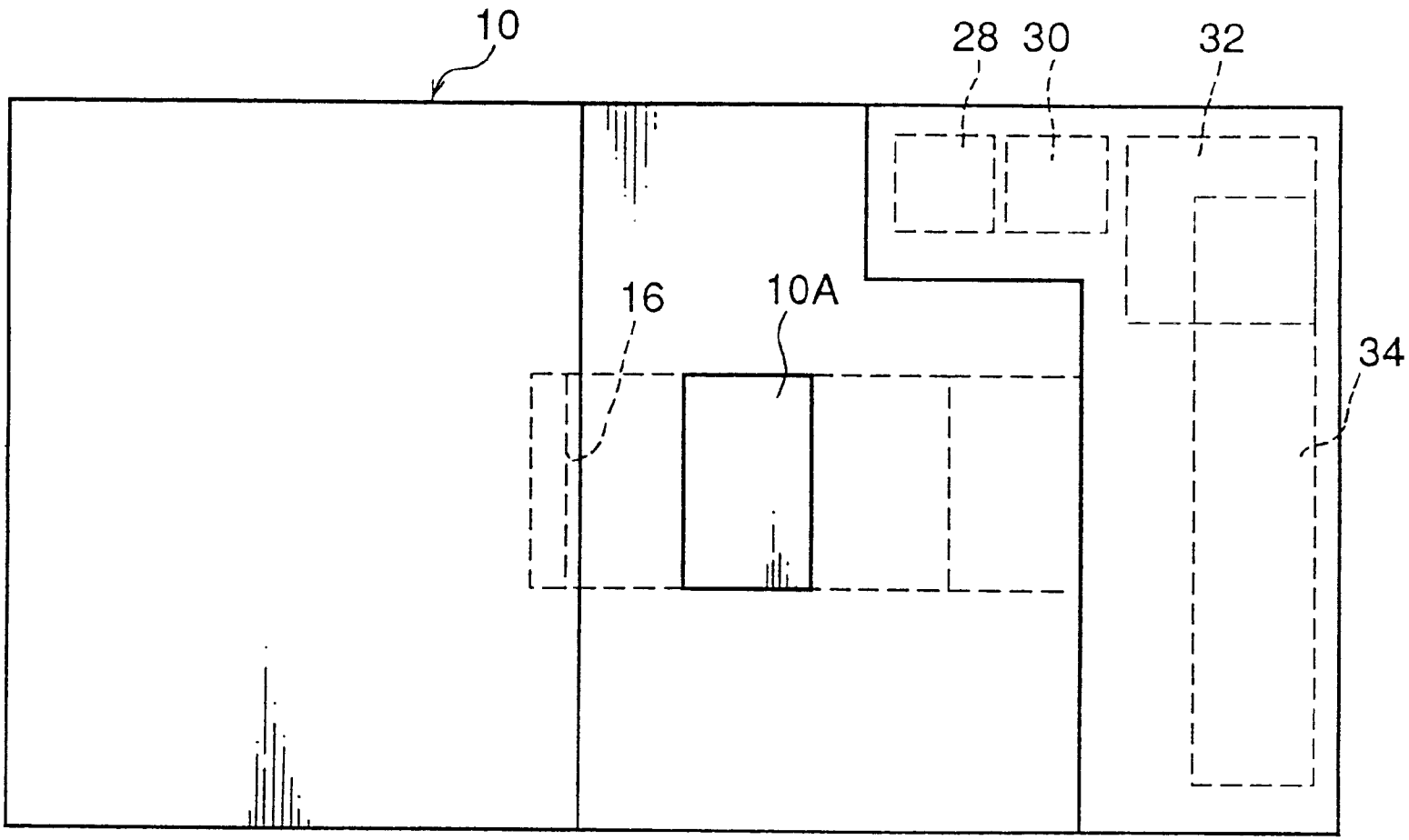
FIG. 2 is a schematic plan view illustrating the image forming device relating to the embodiment of the present invention.

FIG. 1 illustrates an overall schematic structure of an image forming device provided with a processing solution applying device relating to the embodiment of the present invention.

In the image forming device illustrated in FIG. 1, a paper feed portion 12 is provided within a device main body 10 at the lower right side region thereof as shown in FIG. 1. A conveying path 14 that begins at the paper feed section 12 is provided continuously to a discharge opening 16 at the upper portion of the device main body 10, while curving through the interior of the device main body 10. Within the device main body 10, on the conveying path 14 and in order from the paper feed section 12 are provided an exposure section 18, a developing section 20, a bleaching-fixing section 22, a after-processing section 24, a drying section 26, and the discharge opening 16. The exposure section 18 exposes an image onto a photosensitive material, which is an image recording material, which is sent in from the paper feed section 12. The discharge opening 16 discharges the photosensitive material on which an image has been formed. These respective sections are automatically operated by a control section (not shown).

Further, a tank 28 for developing solution, a tank 30 for bleaching-fixing solution, a tank 32 for washing water, and a waste solution tank 34 are provided in the device main body 10.

A photosensitive material, which is an image recording material formed in a strip-like form, is wound up in a roll form and is accommodated in the paper feed section 12 of the image forming device. The leading end portion of the photosensitive material which has been pulled out from the outer peripheral end portion of the roll is fed out onto the conveying path.

Feed rollers 36 are disposed along the conveying path 14. The photosensitive material is nipped between rotating pairs of the feed rollers 36 so as to be fed along the conveying path 14 from the upstream side of the conveying path 14 near the paper feed section 12 to the downstream side of the conveying path near the discharge opening 16.

The photosensitive material which is fed out onto the conveying path 14 from the paper feed section 12 is, while being conveyed on the conveying path 14, cut into pieces of predetermined sizes by a cutter 38 disposed near the paper feed section 12, and the cut photosensitive material is fed to the exposure section 18.

At the exposure section 18, color image signals inputted from a scanner (not shown) or the like are subjected to image processing, and the photosensitive material positioned at a predetermined position on the conveying path 14 is exposed by laser light sources of a semiconductor laser unit, such that a latent image is formed on the photosensitive material. The photosensitive material on which the latent image is formed is fed along the conveying path 14 to the developing section 20.

Figure 4:
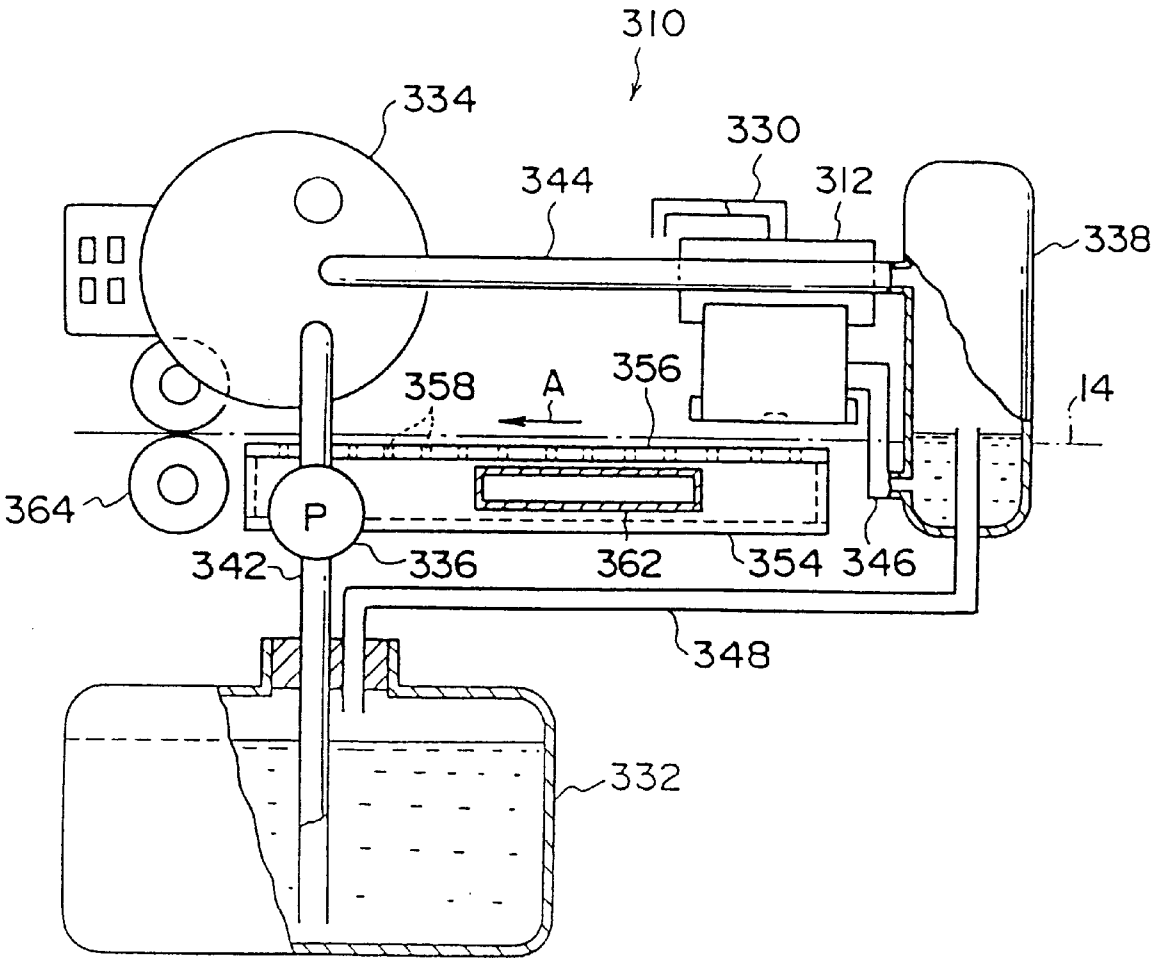
FIG. 4 is an enlarged partial sectional rear view illustrating a partial section of an example of a structure as seen from the rear side of FIG. 1, with a portion of a processing solution applying device of the image forming device relating to the embodiment of the present invention being removed.

The developing section 20 includes a processing solution applying device, a conveying device, and a heating temperature adjusting device. The processing solution applying device is, for example, as in the embodiments illustrated in FIGS. 4–8, an applying device 310 which applies processing solution for processing a photosensitive material onto only a surface of the photosensitive material at which surface the image forming layers are provided. A solution spraying device 312 is provided at the applying device 310. As illustrated in FIG. 4, a developing solution bottle 332, which contains developing solution to be fed to the solution spraying device 312, is provided at the lower left (in FIG. 4) of the solution spraying device 312. A filter 334 which filters the developing solution is provided above the developing solution bottle 332. A solution feed pipe 342, along which a pump 336 is disposed, connects the developing solution bottle 332 and the filter 334.

An auxiliary tank 338, which holds developing solution fed from the developing solution bottle 332, is provided at the right side, in FIG. 4, of the solution spraying device 312. A solution feed pipe 344 extends from the filter 334 to the auxiliary tank 338.

Accordingly, when the pump 336 is activated, developing solution is fed from the developing solution bottle 332 to the filter 334, and the developing solution which is filtered by passing through the filter 334 is fed to the auxiliary tank 338 where it is held temporarily.

A solution feed pipe 346, which connects the auxiliary tank 338 and the solution spraying device 312, is disposed therebetween. Developing solution, which is fed by the pump 336 from the developing solution bottle 332 via the filter 334, the auxiliary tank 338 and the solution feed pipe 346, is filled into the solution spraying device 312.

One end of a circulating pipe 348 is connected to the developing solution bottle 332. The circulating pipe 348 is connected to the auxiliary tank 338 such that it protrudes and extends into the auxiliary tank 338. Of the developing solution stored in the auxiliary tank 338, the developing solution in excess of that which is needed is returned to the developing solution bottle 332 through the circulating pipe 348. Further, the developing solution bottle 332 is connected to the developing solution tank 28 shown in FIG. 1 by a solution feed pipe (not shown), so that developing solution within the tank 28 can be replenished as needed to the bottle 332. The developing solution bottle 332 and the developing solution tank 28 may be combined in a single structure.

As illustrated in FIG. 4, a chamber 354, which is box-shaped and whose interior is hollow, is disposed at the side of the photosensitive material conveying path 14 opposite the side at which the solution spraying device 312 is disposed, at a position which is at the photosensitive material conveying direction downstream side of the solution spraying device 312. The upper portion of the chamber 354 is covered by a heating plate 356 which serves as a heating temperature adjusting device and is a smooth, flat plate in which a heater or the like (not shown) is included. Plural suction holes 358, which pass through between the interior and exterior of the chamber 354, are formed at equal intervals in the heating plate 356.

A fan (not shown) for sucking air from the interior of the chamber 354 is provided at one end side of the chamber 354. A duct 362 connects the fan and the chamber 354.

By operating the fan, the air within the chamber 354 is sucked via the duct 362, and accordingly, a non-coated surface (the bottom side surface in FIG. 4) of the photosensitive material is sucked by the suction holes 358 of the suction plate 356, and the heating plate 356 heats the photosensitive material on the conveying path 14 and guides the photosensitive material.

Conveying rollers 364, which are a conveying device, are disposed on the photosensitive material conveying path 14 at the downstream side of the solution spraying device 312 and the heating plate 356. The conveying rollers 364 squeeze out, from the photosensitive material to which the developing solution has been applied, excess developing solution, and convey the photosensitive material.

Because the bleaching-fixing section 22 has the same structure as that described above, description thereof will be omitted. However, in place of the developing solution bottle 332, in the bleaching-fixing section 22, a bleaching-fixing bottle which holds bleaching solution is provided. The bleaching solution bottle is connected by a solution feed pipe (not shown) to the bleaching-fixing fixing solution tank 30 illustrated in FIG. 1, such that bleaching solution in the tank 30 can be replenished to the bleaching solution bottle as needed. The bleaching solution bottle and the bleaching-fixing solution tank 30 may be combined into a single structure.

Figure 6:
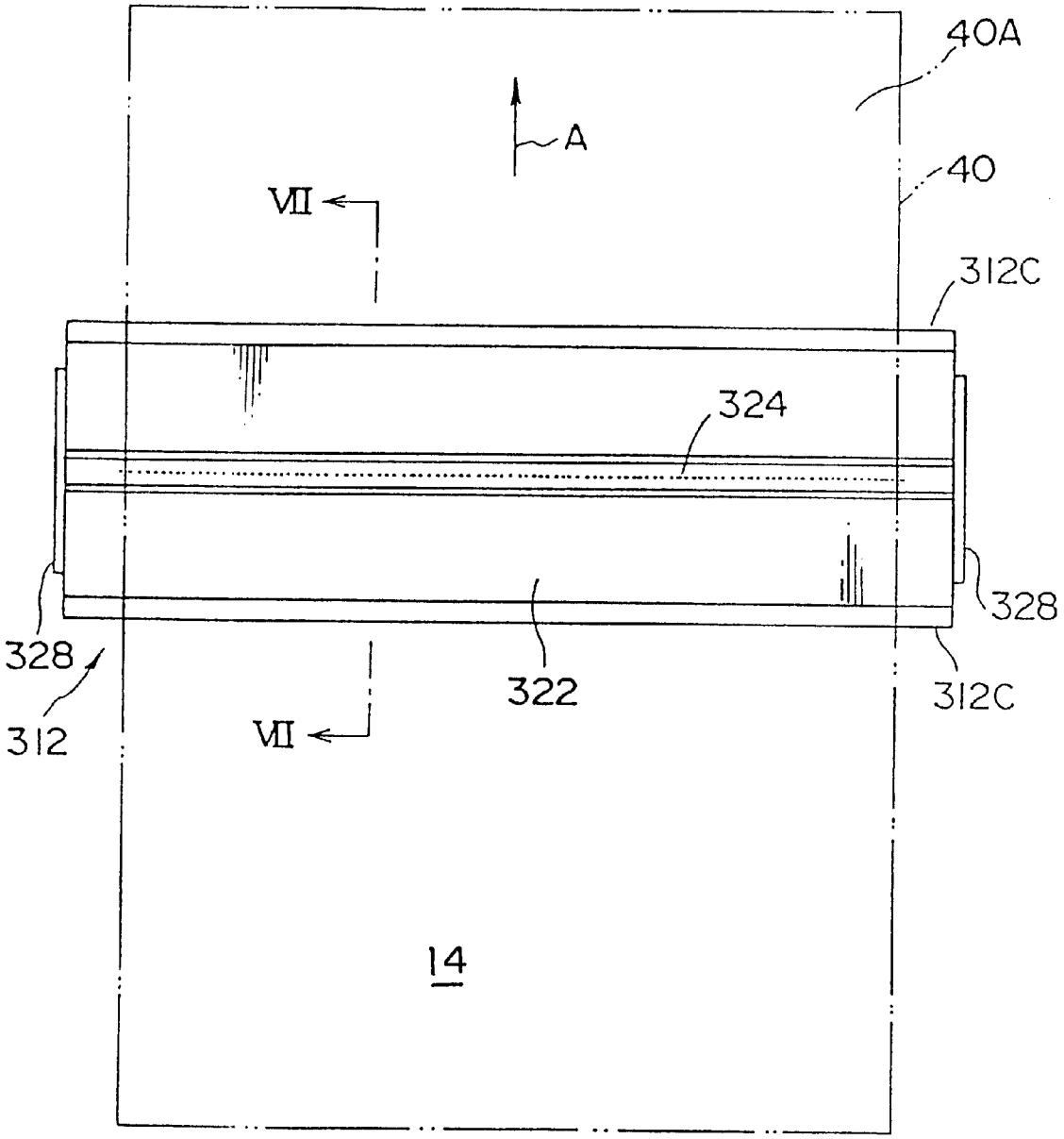
FIG. 6 is a bottom view illustrating a state in which a photosensitive material is being conveyed beneath a solution spraying device of the image forming device relating to the embodiment of the present invention.
Figure 7:
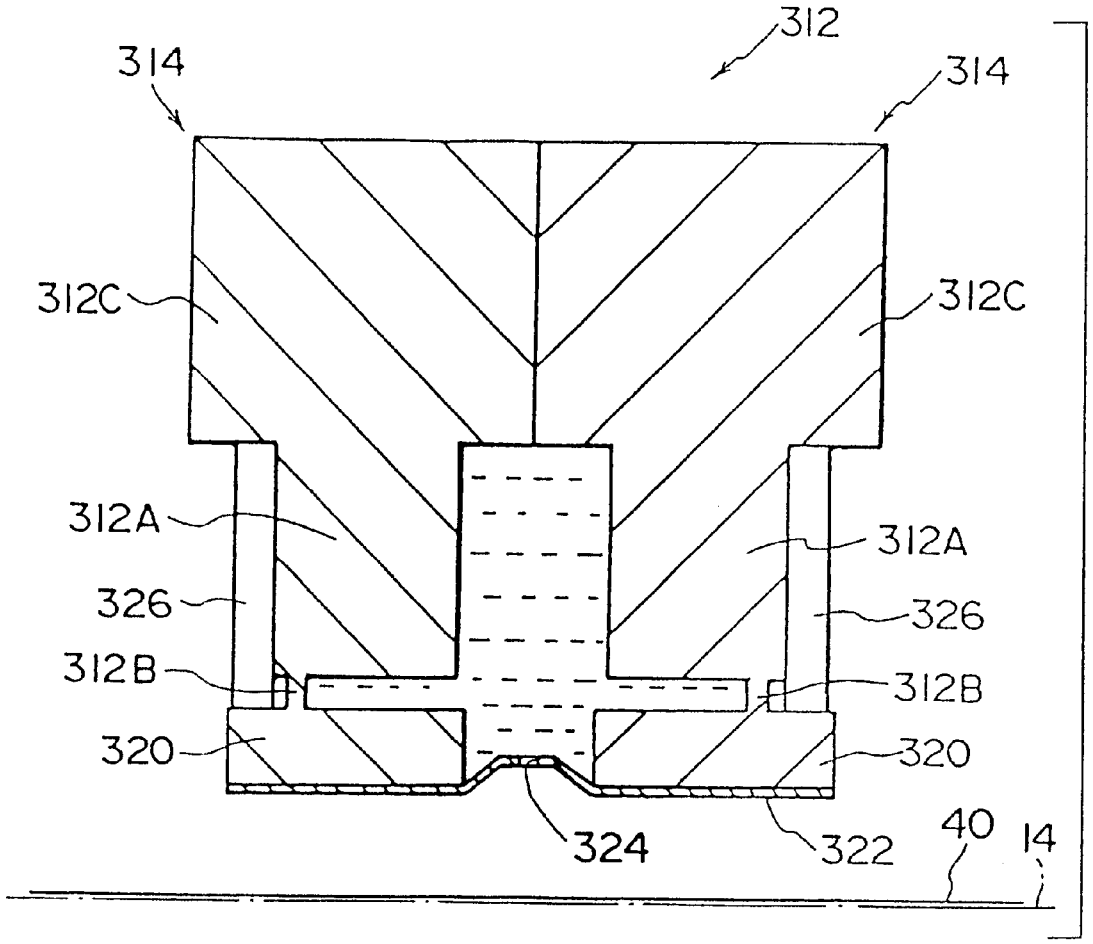
FIG. 7 is a sectional view of the solution spraying device, illustrating a cross-section along line VII—VII in FIG. 6 of the image forming device relating to the embodiment of the present invention.

As illustrated in FIGS. 6 and 7, a nozzle plate 322, which is formed by bending a thin, rectangular, elastically-deformable plate, forms a portion of a wall surface of the solution spraying device 312, and is disposed so as to oppose the conveying path 14 of the photosensitive material.

As is shown in FIGS. 6 and 7, plural nozzle holes 324 (respectively having a diameter of, for example, several tens of $\mu$m), which spray the developing solution filled in the solution spraying device 312, are formed in the nozzle plate 322 so as to be aligned at fixed intervals in a straight line along a direction intersecting a conveying direction A of a photosensitive material 40 over the entire transverse direction of the photosensitive material 40. As a result, the developing solution in the solution spraying device 312 can be discharged toward the photosensitive material 40 from the nozzle holes 324.

Figure 5:
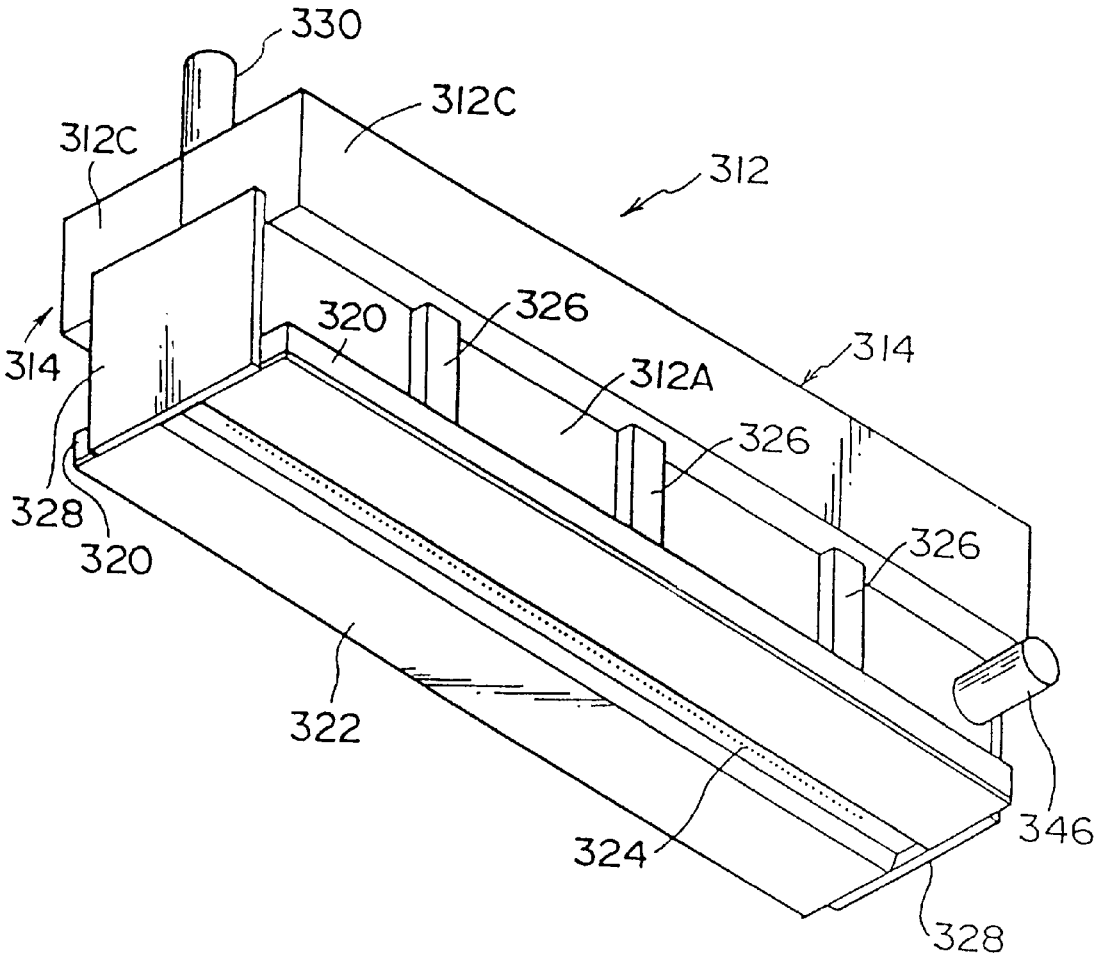
FIG. 5 is an enlarged perspective view illustrating a solution spraying device portion of the processing solution applying device of the image forming device relating to the embodiment of the present invention.

As is shown in FIGS. 4 and 5, an exhaust pipe 330 extends from the top portion of the solution spraying device 312, and communicates the interior and the exterior of the solution spraying device 312. A valve (not shown) for opening and closing the exhaust pipe 330 is provided at the exhaust pipe 330. By opening and closing the valve, the interior of the solution spraying device 312 is made to communicate with or is closed of from the outside air.

As can be seen in FIG. 7, the end portions of the nozzle plate 322, which are the end portions of the nozzle plate 322 positioned in a direction orthogonal to the longitudinal direction of the linearly-aligned plural nozzle holes 324, are adhesively connected by an adhesive or the like to a pair of lever plates 320, so that the nozzle plate 322 and the lever plates 320 are thereby connected. The lever plates 320 are fixed to side walls 312A via thin-width supporting portions 312B formed at the bottom portions of the side walls 312A.

Respective portions of a pair of top walls 312C, which abut against each other and form the top surface of the solution spraying device 312, project toward the outer sides of the solution spraying device 312. Plural piezo-electric elements 326 which are actuators are adhered beneath the projecting top walls 312C. (In the present embodiment, there are three piezo-electric elements 326 beneath each top wall 312C.) The outer end sides of the lever plates 320 are adhered to the bottom surfaces of the piezo-electric elements 326, so that the piezo-electric elements 326 and the lever plates 320 are connected.

The lever plate 320, the side wall 312A, the supporting portion 312B and the top wall 312C are portions of an integrally formed frame 314. As illustrated in FIG. 7, a pair of frames 314 are placed together and are fastened together by screws and bolts (not shown), so that a pair of the lever plates 320, a pair of the side walls 312A, a pair of the top walls 312C and a pair of the supporting portions 312B are disposed to oppose each other. In this state, the external frame of the solution spraying device 312 is formed.

As can be seen in FIGS. 5 and 6, thin sealing plates 328 are adhered to the pair of frames 314 at portions defined by left and right ends of the nozzle plate 322, which are the end portions of the nozzle plate 322 positioned in the longitudinal direction of the nozzle holes 324, and by the end portions of the pair of frames 314.

An elastic adhesive which is, for example, a silicone rubber adhesive, is filled in at the inner sides of the sealing plates 328 in the gaps formed between the sealing plates 328 and the left and right ends of the nozzle plates 322 and in the gaps formed between the sealing plates 328 and the end portions of the pair of frames 314, so that developing solution does not leak therefrom. Accordingly, the gaps at the supplying tank 312 can be sealed by an elastic adhesive without hindering the movement of the left and right ends of the nozzle plate 322. Further, the left and right ends of the solution spraying device 312 may be sealed by using only an elastic adhesive and without using the thin sealing plates 328.

Figure 8:
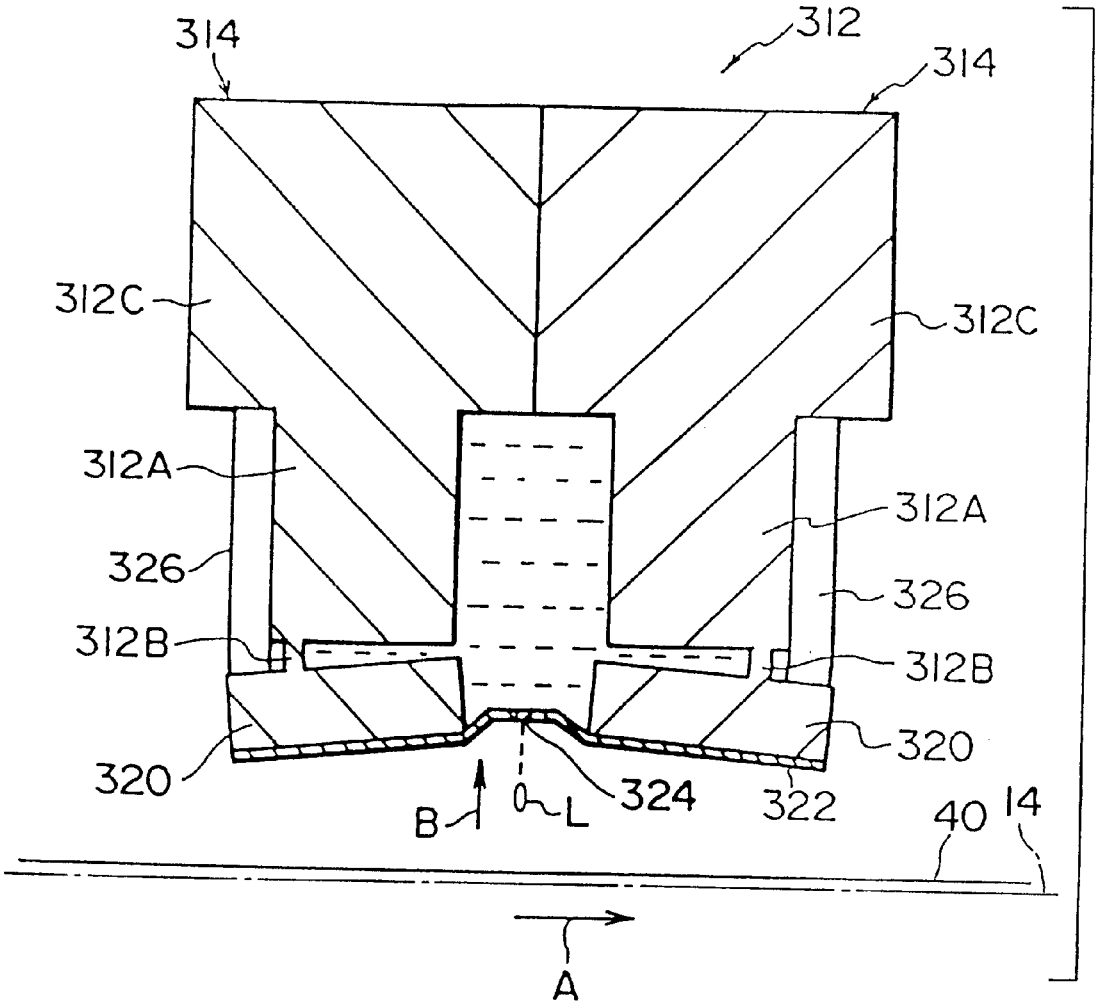
FIG. 8 is a sectional view illustrating a section, corresponding to FIG. 7, in a state in which water is being sprayed from the solution spraying device of the image forming device relating to the embodiment of the present invention.

When electricity is supplied from the power source to the piezo-electric elements 326, as illustrated in FIG. 8, the piezo-electric elements 326 extend, and as the lever plates 320 rotate around the supporting portions 312B, the nozzle plate 322 is displaced while being deformed so that the piezo-electric elements 326 cause the central portion of the nozzle plate 322 to rise up along the arrow B. As the nozzle plate 322 is deformed, the pressure of the developing solution within the solution spraying device 312 increases such that small amounts of the developing solution L are sprayed at once in a line from the nozzle holes 324.

The solution spraying device 312 of the bleaching-fixing section 22 has the same structure and the same operation as those described above.

The solution spraying device 312 is provided with a solution discharging device which discharges processing solution from the solution spraying device 312 after the spraying operation of the processing solution has been completed. The solution discharging device is formed such as the structure illustrated in, for example, FIGS. 9 and 10, such that, while the solution discharging device is not in use (is not carrying out spraying operation), the processing solution does not contact the nozzle hole portions 324 of the solution spraying device 312 so as to prevent the moisture in the processing solution at the nozzle hole portions 324 from evaporating and the components from precipitating and clogging the nozzle holes 324.

Figure 9:
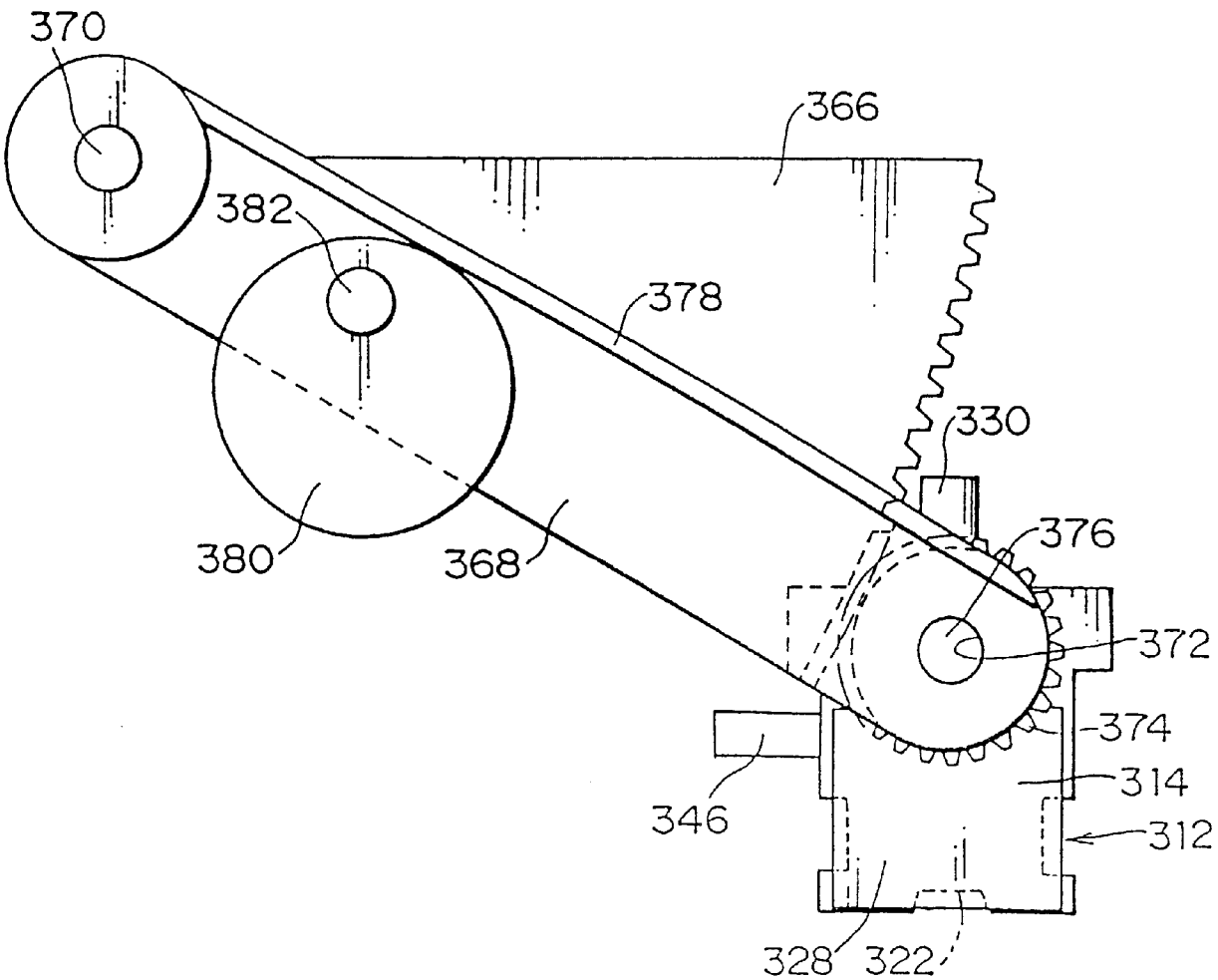
FIG. 9 is a front view illustrating a state of use, wherein a portion of a rotating supporting mechanism, which supports the solution spraying device and is provided in the image forming device relating to the embodiment of the present invention, is removed.
Figure 10:
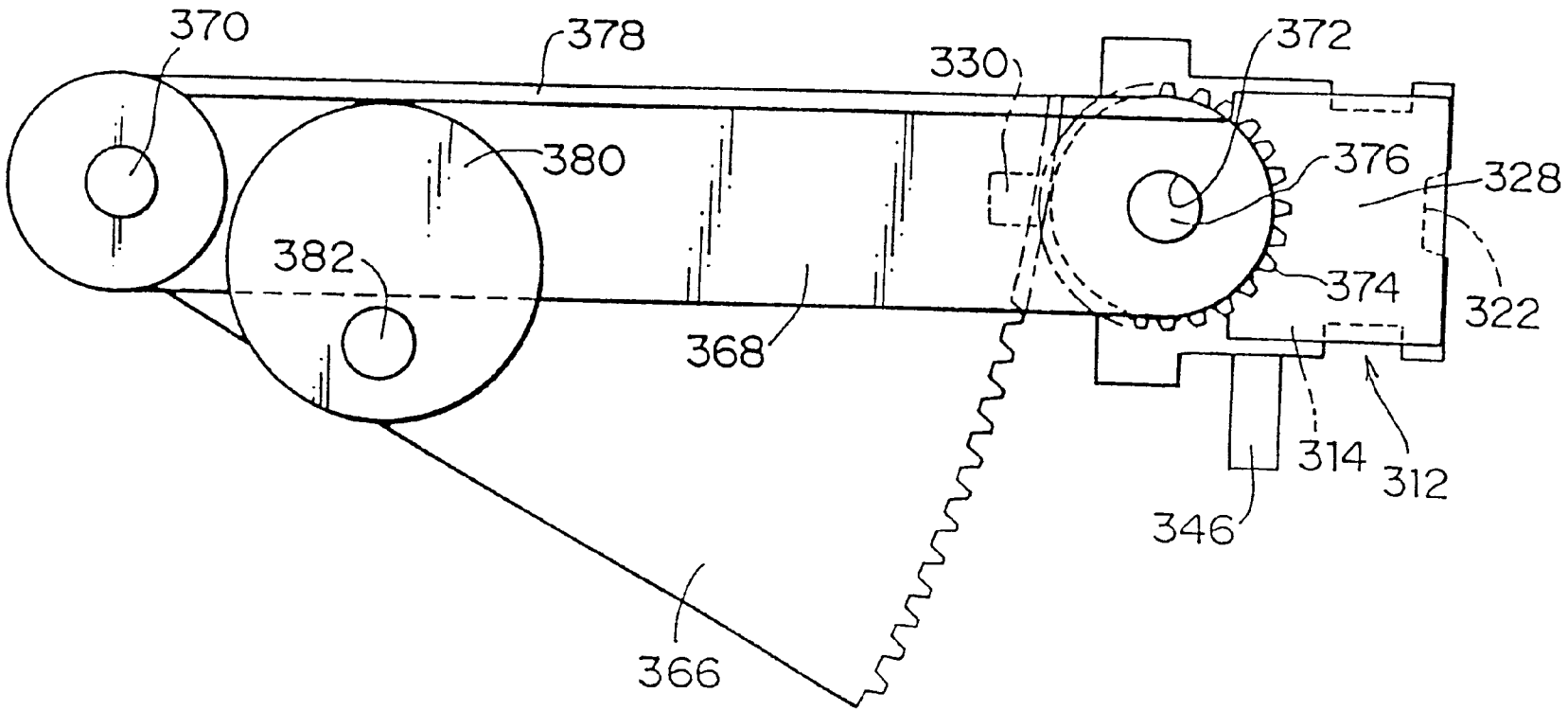
FIG. 10 is a front view corresponding to FIG. 9 and illustrating a solution discharging state, wherein a portion of the rotating supporting mechanism, which supports the solution spraying device and is provided in the image forming device relating to the embodiment of the present invention, is removed.

Namely, the solution discharging device of the solution spraying device 312 is structured so as to be rotatable by a rotating supporting mechanism between the state of use shown in FIG. 9 and the solution discharging state shown in FIG. 10. In order to form the rotating supporting mechanism, a fixed gear portion 366, which is formed in a fan-shape as one portion of a large-diameter outer-tooth gear, is fixed to a stand of the device main body 10. One end portion of an arm member 368 is rotatably set at the center of the fixed gear portion 366 so as to be concentric with the fixed gear portion 366 at a shaft pin 370.

A shaft hole 372 is formed in the other end portion of the arm member 368. A shaft rod 376 of a driven gear 374 which is a small-diameter outer tooth gear is rotatably set in the shaft hole 372. The driven gear 374 which is rotatably set at the free end of the arm member 368 in this way is disposed so as to rotate while meshing with the outer teeth of the fixed gear portion 366. The shaft rod 376 of the driven gear 374 is fixed to respective end portions of the sealing plates 328 at the frames 314 of the solution spraying device 312 such that the driven gear 374 and the solution spraying device 312 rotate integrally.

A cam mechanism serving as a driving operating device for rotating the arm member 368 is provided. In order to form the driven section of the cam mechanism, a driven side 378, which extends out in an inverse-L shaped cross-section, is formed integrally with a longitudinal direction upper side portion of the arm member 368.

A circular-plate-shaped plate cam 380, with a rotating driving shaft 382 fixed to an eccentric position thereof, serves as the driving section of the cam mechanism. The outer periphery of the plate cam 380 slides on the bottom surface of the driven side 378.

In the state of use illustrated in FIG. 9 of the solution spraying device 312 which is supported by the rotating supporting mechanism as described above, the arm member 368 is supported such that the solution spraying device 312 abuts the driven side 378 at a predetermined position at which the distance between the arm member 368 and the rotating driving shaft 382 on the outer periphery of the plate cam 380 approaches the minimum, and the driven gear 374 which is rotatably supported at the arm member 368 meshes with the fixed gear portion 366 such that the rotation of the driven gear 374 is stopped. The state of use is held thereby.

Next, when use of the image forming device is finished, when the processing solution is to be removed from the solution spraying device 312, the solution spraying device 312 is rotated and turned sideways, so as to be set in the solution disposal state. This is accomplished as follows. The plate cam 380, which is integral with the rotating driving shaft 382, is rotated 180° by the driving source (not shown) from the state of use illustrated in FIG. 9. Therefore, the plate cam 380 is rotated while the outer periphery thereof is slid along the driven side 378, and at a predetermined position at which the distance from the rotating driving shaft 382 at the outer periphery of the plate cam 380 to the arm member 368 becomes large, the plate cam 380 abuts the driven side 378 so that the arm member 368 is supported. By rotating the plate cam 380, the arm member 368 is rotated. The solution spraying device 312 is rotated 90° integrally with the driven gear 374 meshed with the fixed gear portion 366, so as to be set in the sideways oriented state illustrated in FIG. 10.

In the solution disposing state illustrated in FIG. 10, the processing solution in the solution spraying device 312 flows backward through the solution feed pipe 346 to be discharged of. At this time, when the solution spraying device 312 is rotated sideways as illustrated in FIG. 10, in this state, the pipe opening of the solution feed pipe 346, which opens to the solution holding chamber inner wall of the solution spraying device 312, is disposed lower, along the vertical direction, than the position of the nozzle holes 324 of the nozzle plate 322. Thus, when the solution within the solution spraying device 312 is to be discharged out from the solution feed pipe 346, the level of the processing solution remaining in the solution spraying device 312 is lower than the position of the nozzle holes 324, and thus, in the state in which the solution spraying device 312 is turned sideways, the processing solution remaining in the solution holding chamber does not contact the nozzle holes 324 portion. In this way, at the nozzle holes 324 portion, evaporation of moisture from the processing solution and clogging of the nozzle holes 324 due to the components precipitating can be prevented.

Until the image forming device is used again, the solution spraying device 312 is on stand-by in the above-described sideways-turned state. Then, when the image forming device is to be used again, by operating the rotating supporting mechanism in the opposite order of the operations described above, the solution spraying device 312 can be returned from the solution discharging state illustrated in FIG. 10 to the position for the usage state illustrated in FIG. 9, and processing operation is started again.

In addition to the above-described structure, the processing solution applying device may be structured as illustrated, for example, in FIGS. 11 through 15. Among these structures, there are those in which the direction of application is opposite to the above-described spray type, i.e., processing solution is applied from the bottom of the photosensitive material. Therefore, in such cases, the conveying device is disposed such that the photosensitive material is conveyed with the surface to be coated thereof facing downward.

Figure 11:
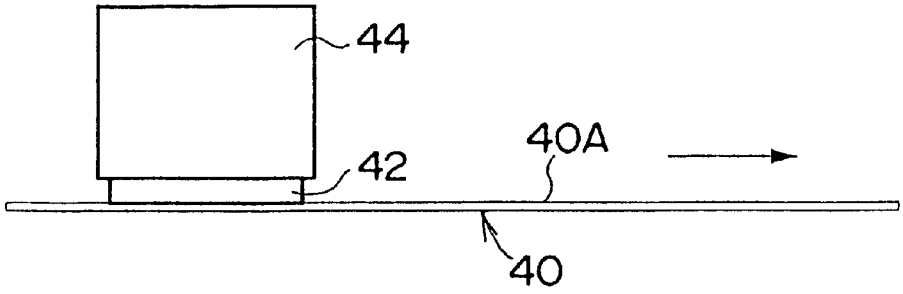
FIG. 11 is a side view illustrating an example of the schematic structure of a felt pen type device which can be used as the processing solution applying device of the image forming device relating to the embodiment of the present invention.

The device illustrated in FIG. 11 is a so-called felt type device in which a felt coating member 42, which serves as a hard body and which is soaked with processing solution, is slid only on a photosensitive material emulsion surface 40A which is one surface of the photosensitive material 40 so as to apply the processing solution thereto. In this felt type processing solution applying device, control is effected such that developing solution which is a processing solution is fed by a processing solution supplying device (not shown) from the developing solution tank 28 to the felt coating member 42 which is formed from a blade-shaped felt material which is an absorbent elastic body, and such that the amount of developing solution supplied by a supply amount controlling device 44 for the developing solution is an appropriate amount.

Figure 12:
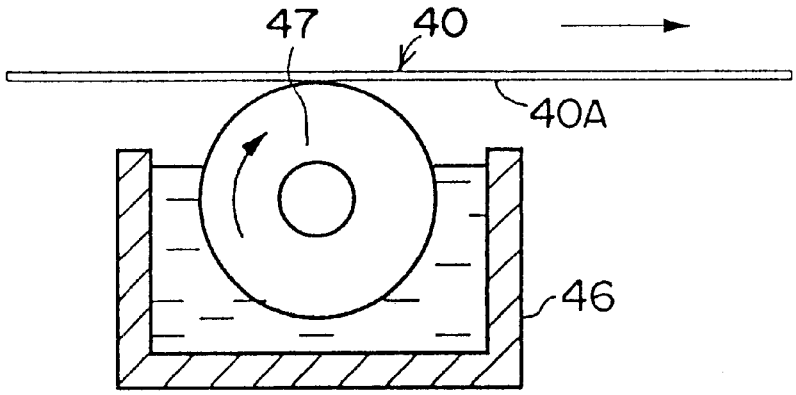
FIG. 12 is a sectional view illustrating an example of the schematic structure of a roller beat type device which can be used as the processing solution applying device of the image forming device relating to the embodiment of the present invention.

The processing solution applying device illustrated in FIG. 12 is a so-called roller beat type device. A roller 47, of which at least a portion thereof is immersed in processing solution in a processing solution tank 46, is made to roll on and contact only the photosensitive material emulsion surface 40A which is one surface of the photosensitive material 40, so as to apply the processing solution thereto.

Figure 13:
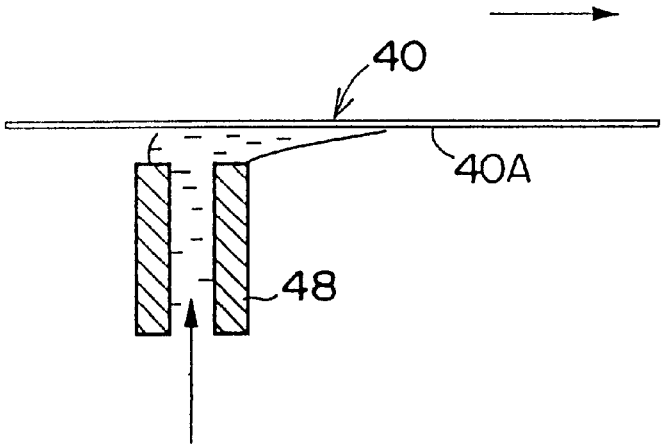
FIG. 13 is a sectional view illustrating an example of the schematic structure of a geyser type device which can be used as the processing solution applying device of the image forming device relating to the embodiment of the present invention.

The processing solution applying device illustrated in FIG. 13 is what is known as a geyser type device. A viscous processing solution is pushed out from a slit member 48, and is applied to only the photosensitive material emulsion surface 40A which is one surface of the photosensitive material 40.

Figure 14:
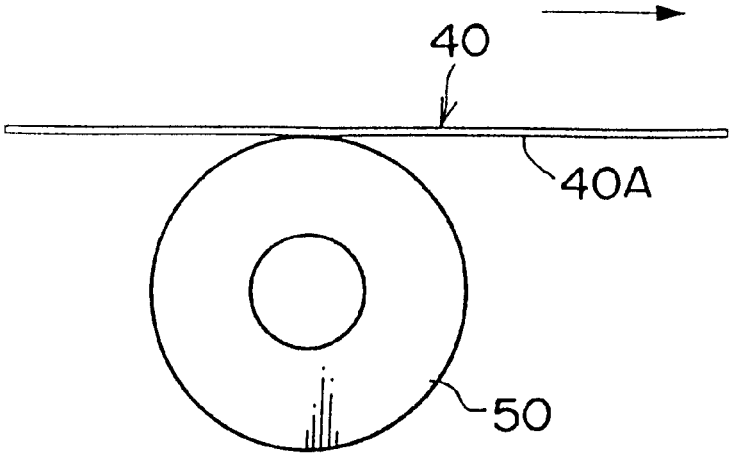
FIG. 14 is a side view illustrating an example of the schematic structure of a porous roller type device which can be used as the processing solution applying device of the image forming device relating to the embodiment of the present invention.

The processing solution applying device illustrated in FIG. 14 is a porous roller type device. In a state in which processing solution is supplied to the interior of a porous roller 50 such that the porous roller 50 becomes soaked therewith, the porous roller 50 is rotated while contacting the photosensitive material emulsion surface 40A which is one surface of the photosensitive material, so as to apply the processing solution thereto.

Figure 15:
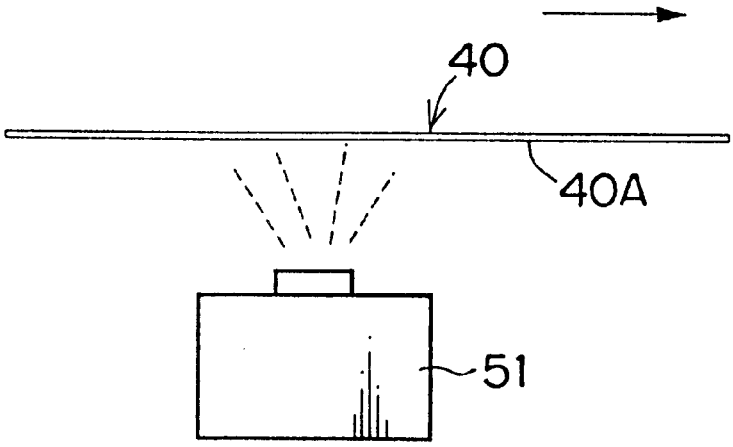
FIG. 15 is a side view illustrating an example of a schematic structure of a mist type device which can be used as the processing solution applying device of the image forming device relating to the embodiment of the present invention.

The processing solution applying device illustrated in FIG. 15 is a mist type device. Processing solution from a misting device 51 is sprayed only onto the photosensitive material emulsion surface 40A which is the bottom surface of the photosensitive material 40, so as to be applied thereto.

In the developing section 20 structured as described above, at the upstream side of the conveying device, processing solution is applied by the processing solution applying device to the photosensitive material emulsion surface 40A of the photosensitive material 40 which is being conveyed. Chemical reactions take place while the photosensitive material 40 to which the processing solution has been applied is conveyed by the conveying device while being heated and maintained at a predetermined temperature by the heating temperature adjusting device. Developing processing is completed, and the photosensitive material 40 is then fed to the bleaching-fixing section 22.

The bleaching-fixing section 22 includes a processing solution applying device, a conveying device, and a heating temperature adjusting device. In the present embodiment, the bleaching-fixing section 22 is structured similarly to the above-described developing section 20.

In the bleaching-fixing section 22, at the upstream side of the conveying device, processing solution is applied by a processing solution applying device to the photosensitive material emulsion surface 40A of the photosensitive material 40 which is being conveyed by conveying rollers 364. While the photosensitive material 40 to which processing solution has been applied is conveyed by the conveying device while being heated and maintained at a predetermined temperature by the heating temperature adjusting device, chemical reactions take place and bleaching-fixing processing is completed.

The structures of the developing section 20 and the bleaching-fixing section 22 are not limited to the above-described structures, and various other structures are possible.

The photosensitive material which has been processed at the developing section 20 and then at the bleaching-fixing section 22 which follows thereafter is conveyed to the after-processing section 24 along the conveying path 14.

As illustrated by the schematic structural view of the entire image forming device in FIG. 1, the after-processing section 24 is structured by eight cascades 52 (52A, 52B, 52C, 52D, 52E, 52F, 52G, 52H), which are disposed in a row from a first to an eighth cascade 52 aligned from the upstream side to the downstream side of the conveying path 14. Each of the cascades 52 (52A, 52B, 52C, 52D, 52E, 52F, 52G, 52H) has a processing solution chamber 54 and a squeeze chamber 56 disposed adjacent to and at the downstream side of the processing solution chamber 54.

One or more processing solution rollers 58, which correspond to the emulsion surface which is one surface of the photosensitive material, and which serve as a processing solution applying device which is a hard phase, are supported at each of the processing solution chambers 54. (In the present embodiment, there are two processing rollers 58 for each processing solution chamber 54.) The processing solution roller 58 is formed by an absorbent, elastic body such as a foamed sponge with continuous pores, a foamed sponge with independent pores, an isotropic or anisotropic sponge, or is formed from a material such as stainless steel. In each of the processing solution chambers 54, the processing solution rollers 58 are disposed so as to border on the upper side open portion of the processing solution chamber 54. Water serving as a processing solution is held within each processing solution chamber 54 such that the water level is at an extent so that about one half of the processing solution roller 58 in the radial direction thereof is submerged. The processing solution rollers 58 are structured so as to be driven forward and in reverse by a motor and a rotational force transmitting mechanism (both not shown).

The after-processing section 24 is structured such that the vertical direction positions of the cascades 52A through 52H rise successively in a stepwise form from the most upstream side first cascade 52A to the most downstream side eighth cascade 52H.

A solution feed device (not shown) is provided between each of the cascades 52. The solution feed device forms a dam and a solution path so that solution can flow, without backflowing, from the eighth cascade 52H, which is at the highest position, to the next highest seventh cascade 52G, and from the seventh cascade 52G to the sixth cascade 52F and the like. Further, water stored in the washing water tank 32 is supplied to the processing solution chamber 54 of the eighth cascade 52H by a solution feed device (not shown) which can control the amount of flow. Moreover, a solution discharging device (not shown) is connected to the processing solution chamber 54 of the first cascade 52A, so that solution in excess of the predetermined amount housed in this processing solution chamber 54 is discharged to the waste solution tank 34.

In the after-processing section 24 structured as described above, the fresh water (or rinsing solution) supplied to the eighth cascade 52H by the supplying device from the washing water tank 32 flows, due to the solution feed devices, from the eighth cascade 52H via the seventh cascade 52G, the sixth cascade 52F, fifth cascade 52E, fourth cascade 52D, third cascade 52C and second cascade 52B to the first cascade 52A, and is discharged into the waste solution tank 34 by the solution discharging device.

The squeeze rollers 60, serving as a squeezing device, are provided in the squeeze chamber 56 at each cascade 52. The pair of squeeze rollers 60 are disposed parallel to one another and such that they are rotated with the respective outer peripheries thereof contacting one another. By the photosensitive material being nipped between the pair of squeeze rollers 60 and the rollers rotating, the solution adhering to the emulsion surface of the photosensitive material is squeezed out and the photosensitive material is conveyed.

In the after-processing section 24 structured as described above, the photosensitive material, which has been processed in the developing section 20 and the bleaching-fixing section 22 and to which is adhered remaining solutions of the solutions used in processing the emulsion surface of the photosensitive material, is conveyed from the feed rollers 36 of the conveying path 14 into the first cascade 52A. The photosensitive material enters into the processing solution chamber 54 of the first cascade 52A, and the emulsion surface which is one surface of the photosensitive material contacts the processing solution rollers 58. The photosensitive material is conveyed to the squeezing chamber 56 while being wiped such that the concentration of the remaining solutions on the emulsion surface is reduced by substantially half by the washing water adhering to the processing solution rollers 58. In the squeezing chamber 56, the washing water adhering to the emulsion surface of the photosensitive material is squeezed out by the squeezing rollers 60, and the photosensitive material is then fed into the second cascade 52B. At this time, in the processing solution chamber 54 of the first cascade 52A, the remaining processing solutions adhering to the emulsion surface of the photosensitive material adhere to the processing solution rollers 58 and become mixed in with the washing water within the processing solution chamber 54. Therefore, the concentration of the remaining solutions in the washing water is highest in the washing water in the processing solution chamber 54 of the first cascade 52A. Further, due to the solution feed device, the washing water in the processing solution chamber of the first cascade 52A does not become mixed in with the washing water in the processing solution chamber of the second cascade 52B, and due to the squeezing rollers 60, the washing water of the first cascade 52A does not adhere to the photosensitive material by squeezing and does not become mixed in with the washing water of the second cascade 52B.

Thus, the photosensitive material, whose concentration of residual solutions on the emulsion surface thereof were reduced by substantially half in the first cascade 52A, is fed into the second cascade 52B. The remaining solutions on the emulsion surface, whose concentration has been cut by substantially half, are wiped by the processing rollers 58 such that the concentrations thereof are reduced to substantially one-quarter. In this way, the concentration of residual solutions in the washing water in the processing chamber 54 of the second cascade 52B is the second highest overall. From the third through the eighth cascades 52C through 52H, i.e., from the upstream side to the downstream side of the path along which the photosensitive material is conveyed within the after-processing section 24, the concentration of residual solutions in the washing water within the respective processing solution chambers 54 gradually decreases. Near the eighth cascade 52H, the concentration of residual solutions adhering to the emulsion surface of the photosensitive material has decreased to a level sufficiently below the standard level below which residual solutions affect photosensitive materials, and washing processing, which is an after-processing, of the photosensitive material is completed.

The after-processing section 24 is provided with an evaporation preventing device which covers the processing solution chambers 54, the processing solution rollers 58, the squeeze rollers 60 and the like with a housing or the like so as to prevent processing solution from evaporating therefrom into the atmosphere.

The after-processing section 24 is also provided with a washing device which, when the after-processing section 24 is not being used, automatically passes the liquid within the washing liquid tank 32 through the pipe 62 and applies the liquid uniformly to the squeezing rollers 60 so as to wash them. The waste solution after washing falls down into the squeezing chambers 56 and is discharged out to the waste solution tank 34 through a discharging pipe (not shown). Further, it is also possible to provide a washing device (not shown) which automatically washes the processing solution rollers 58 with washing solution. If a large amount of washing solution is supplied to the eighth cascade 52H from a solution supplying device, the solution will be supplied by the solution feed devices to the other seventh through first cascades. Therefore, the respective processing solution rollers 58 are washed with the washing solution, and dirt can be washed off therefrom. The processing solution used in the after-processing section 24 is not limited to water or a rinsing solution, and a stabilizer or other processing solution may be used, and the after-processing section 24 can be used for other purposes.

As illustrated in FIG. 1, the photosensitive material which was subjected to washing processing in the above-described after-processing section 24 is fed along the conveying path 14 to the drying section 26.

At the drying section 26, the photosensitive material is conveyed on a belt conveying device 74 using heat rollers 72, and warm air is blown from a warm air device 76 onto the emulsion surface of the photosensitive material which is warmed for drying, so as to dry the photosensitive material.

The photosensitive material which has been dried in the drying section 26 is fed out, as a completed product, from the discharge opening 16 onto the receiving tray 10A at the upper portion of the device main body 10 and is stacked on the tray 10A.

Next, the photosensitive material and the respective processing solutions used in the image forming device of the present embodiment will be described.

The photosensitive material 40 used in the image forming device is a photosensitive material which contains a color developing agent, and the structure thereof is as follows.

Preparation of Photosensitive Material

A gelatin undercoat layer containing sodium dodecylbenzenesulfonate which had been subjected to corona discharge processing was provided on a paper support whose both surfaces had been laminated with polyethylene. Various types of emulsions were coated on the undercoat layer, so as to prepare a multi-layer color photographic printing paper (100) having the following structure. The coating solutions were prepared as follows.

First Layer Coating Solution 23 g of a coupler (C-21), 16 g of a reducing agent for coloring (I-32), and 80 g of a solvent (Solv-1) were dissolved in ethyl acetate. This solution was emulsified and dispersed in 400 g of a 16% gelatin aqueous solution containing 10% sodium dodecylbenzenesulfonate and citric acid, so as to prepare emulsified dispersion A. Further, a silver chlorobromide emulsion A was prepared (cubic; a mixture containing large grain size emulsion A having an average particle size of 0.88 $\mu$m and small grain size emulsion A having an average particle size of 0.70 $\mu$m in a ratio of 3:7 (silver mol ratio); coefficient of variation of the particle size distribution being 0.08 and 0.10, respectively; the emulsions of both sizes existing locally in an amount of 0.3 mol % of silver bromide on the surface of the particle whose base was silver chloride). The following blue-sensitive sensitizing dyes A, B, C were added to the emulsion A, each in an amount of $1.4\times10^{-4}$ mol per mol of silver of large size emulsion A and $1.7\times10^{-4}$ mol per mol of silver of small size emulsion A. Chemical ripening of the emulsion was carried out optimally by adding a sulfur sensitizer and a gold sensitizer. The emulsified dispersion A was mixed and dissolved with this silver chloride bromide emulsion A, so as to prepare a first layer coating solution having the following composition. The coated amount of the emulsion is a silver-converted coated amount.

The coating solutions for the second layer through the seventh layer were prepared in the same manner as the first layer coating solution. 1-oxy-3,5-dichloro-s-triazine sodium salt was used as the gelatin hardener for each layer.

Further, Cpd-2, Cpd-3, Cpd-4, and Cpd-5 were added to each layer such that the total amounts thereof were 15.0 mg/m$^2$, 60.0 mg/m$^2$, 5.0 mg/m$^2$, and 10.0 mg/m$^2$.

The following spectral sensitizing dyes were used in the silver chlorobromide emulsions of the respective photosensitive emulsion layers.

Blue Sensitive Emulsion Layer

Sensitizing Dye A

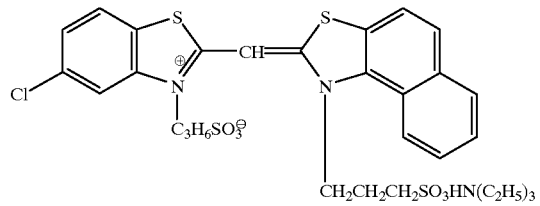

Sensitizing Dye B

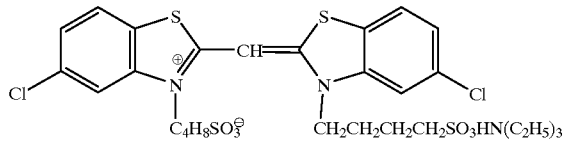

Sensitizing Dye C

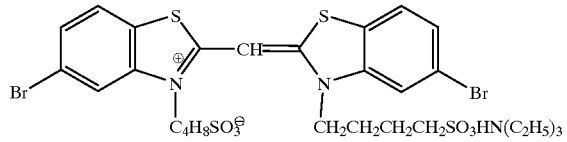

(Each sensitizing dye was added in the following amounts: $1.4\times10^{-4}$ mol per 1 mol of silver halide of the large grain size emulsion, and $1.7\times10^{-4}$ mol per 1 mol of silver halide of the small grain size emulsion.)

Green Sensitive Emulsion Layer

Sensitizing Dye D

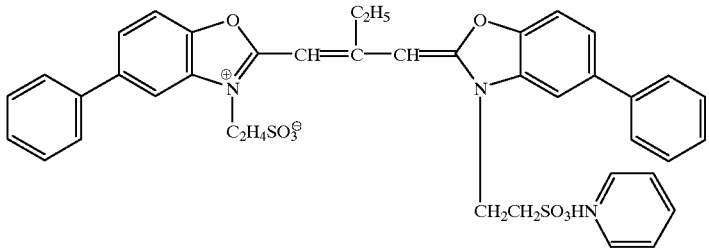

Sensitizing Dye E

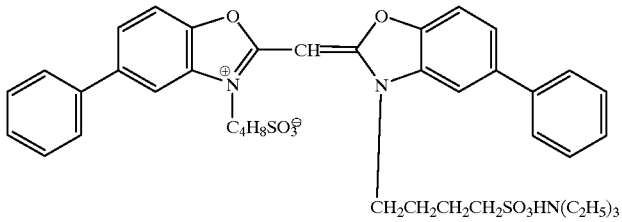

Sensitizing Dye F

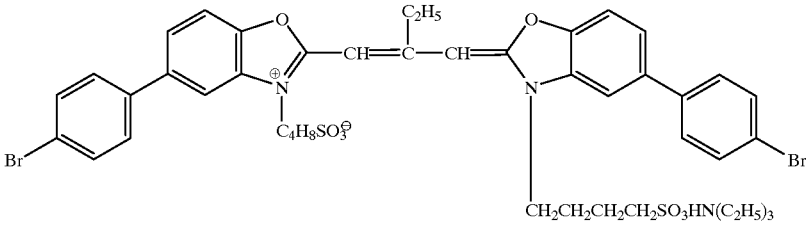

(Sensitizing dye D was added in an amount of $3.0\times10^{-4}$ mol per 1 mol of silver halide of the large grain size emulsion, and $3.6\times10^{-4}$ mol per 1 mol of silver halide of the small grain size emulsion. Sensitizing dye E was added in an amount of $4.0\times10^{-5}$ mol per 1 mol of silver halide of the large grain size emulsion, and $7.0\times10^{-5}$ mol per 1 mol of silver halide of the small grain size emulsion. Sensitizing dye F was added in an amount of $2.0\times10^{-4}$ mol per 1 mol of silver halide of the large grain size emulsion and $2.8\times10^{-4}$ mol per 1 mol of silver halide of the small grain size emulsion.)

Red Sensitive Emulsion Layer

Each of sensitizing dyes G and H was added in the following amounts ($2.5\times10^{-4}$ mol per 1 mol of silver halide of the large grain size emulsion, and $4.0\times10^{-4}$ mol per 1 mol of silver halide of the small grain size emulsion).

Sensitizing Dye G

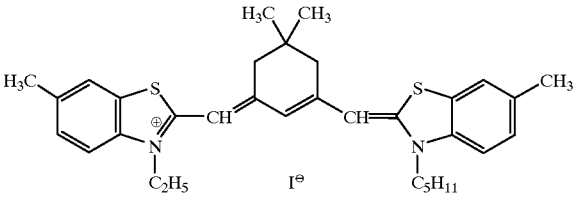

-continued

Sensitizing Dye H

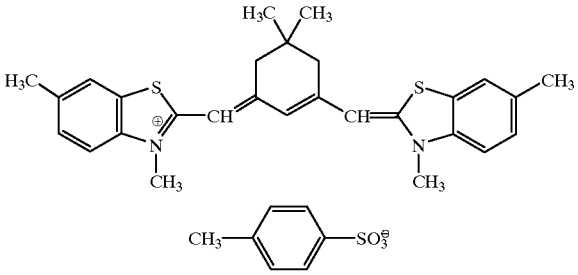

(Each of sensitizing dyes G and H was added in the following amounts: $5.0\times10^{-5}$ mol per 1 mol of silver halide of the large grain size emulsion, and $8.0\times10^{-5}$ mol per 1 mol of silver halide of the small grain size emulsion.)

Further, per 1 mol of silver halide, $2.6\times10^{-3}$ mol of the following compound was included in the red sensitive emulsion layer.

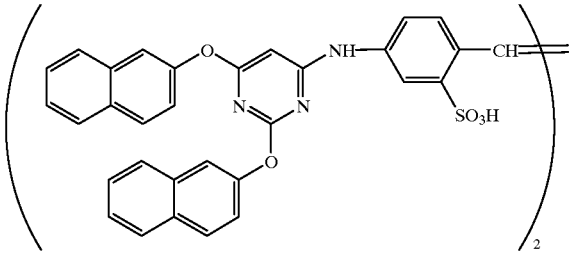

1-(5-methyl-ureidophenyl)-5-mercaptotetrazol was added in amounts, per 1 mol of silver halide, of $3.3\times10^{-4}$ mol, $1.0\times10^{-3}$ mol, and $5.9\times10^{-4}$ mol to the blue sensitive emulsion layer, the green sensitive emulsion layer, and the red sensitive emulsion layer, respectively.

In addition, 1-(5-methyl-ureidophenyl)-5-mercaptotetrazol was added in amounts of 0.2 mg/m$^2$, 0.2 mg/m$^2$, 0.6 mg/m$^2$, 0.1 mg/m$^2$ to the second, fourth, sixth and seventh layers, respectively.

4-hydroxy-6-methyl-1,3,3a,7-tetrazaindene was added in amounts of $1\times10^{-4}$ mol and $2\times10^{-4}$ mol, per 1 mol of silver halide, to the blue sensitive emulsion layer and the green sensitive emulsion layer, respectively.

In order to prevent irradiation, the following dyes were added to the emulsion layers (the blue or red sensitive emulsion layers corresponding to each of the dyes shown below). (The amounts in parentheses express the coated amounts.)

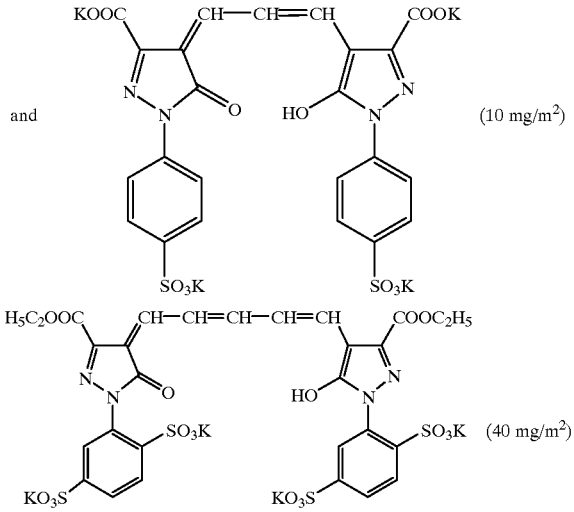

Layer Structure

The structures of the respective layers were as follows. The values are coated amounts expressed in (g/m$^2$). The silver halide emulsion is expressed in silver-converted coated amounts.

Support

Polyethylene Laminate Sheet (The following fluorescent whitening agents (I) and (II), white pigment ($TiO_2$, 15 wt %), and blue dye (ultramarine blue) were contained in the polyethylene at the first layer side.)

| | |
|---|---|
| First Layer (Blue Sensitive Emulsion Layer) | |
| silver chloride bromide emulsion A | 0.20 |
| gelatin | 1.50 |
| yellow dye-forming coupler (C-21) | 0.23 |
| reducing agent for coloring (I-32) | 0.16 |
| solvent (Solv-1) | 0.80 |
| Second Layer (Color Mixing Preventing Layer) | |
| gelatin | 1.09 |
| color mixing preventing agent (Cpd-6) | 0.11 |
| solvent (Solv-2) | 0.19 |
| solvent (Solv-3) | 0.07 |
| solvent (Solv-4) | 0.25 |
| solvent (Solv-5) | 0.09 |
| 1,5-diphenyl-3-pyrazolidone | 0.03 |
| (particle solids dispersed state) | |
| Third Layer (Green Sensitive Emulsion Layer) | |

Silver chloride bromide emulsion B was cubic, and was a mixture containing large grain size emulsion B having an average particle size of 0.55 μm and small grain size emulsion B having an average particle size of 0.39 μm in a ratio of 1:3 (silver mol ratio). The coefficients of variation of the particle size distribution were 0.10 and 0.08, respectively. The emulsions of both sizes existed locally in an amount of 0.8 mol % of AgBr on the surface of the particle whose base was silver chloride.

| | |
|---|---|
| silver chlorobromide emulsion B | 0.20 |
| gelatin | 1.50 |
| magenta dye-forming coupler (C-56) | 0.24 |
| reducing agent for coloring (I-32) | 0.16 |
| solvent (Solv-1) | 0.80 |
| Fourth Layer (Color Mixing Preventing Layer) | |
| gelatin | 0.77 |
| color mixing preventing agent (Cpd-6) | 0.08 |
| solvent (Solv-2) | 0.14 |
| solvent (Solv-3) | 0.05 |
| solvent (Solv-4) | 0.14 |
| solvent (Solv-5) | 0.06 |
| 1,5-diphenyl-3-pyrazolidone | 0.02 |
| (particle solids dispersed state) | |
| Fifth Layer (Red-Sensitive Emulsion Layer) | |

Silver chlorobromide emulsion C was cubic, and was a mixture containing large grain size emulsion C having an average particle size of 0.50 μm and small grain size emulsion C having an average particle size of 0.41 μm in a ratio of 1:4 (silver mol ratio). The coefficients of variation of the particle size distribution were 0.09 and 0.11, respectively. The emulsions of both sizes existed locally in an amount of 0.8 mol % of AgBr on the surface of the particle whose base was silver chloride.

| | |
|---|---|
| silver chlorobromide emulsion C | 0.20 |
| gelatin | 0.15 |
| cyan dye-forming coupler (C-43) | 0.21 |
| reducing agent for coloring (I-16) | 0.20 |
| solvent (Solv-1) | 0.80 |
| Sixth Layer (Ultraviolet Light Absorbing Layer) | |
| gelatin | 0.64 |
| ultraviolet light absorber (UV-1) | 0.39 |
| color image stabilizer (Cpd-7) | 0.05 |
| solvent (Solv-6) | 0.05 |
| Seventh Layer (Protective Layer) | |
| gelatin | 1.01 |
| acrylic-modified copolymer of polyvinyl alcohol (degree modification: 17%) | 0.04 |
| liquid paraffin | 0.02 |
| wettability improving agent (Cpd-8) | 0.3 |
| surfactant (Cpd-1) | 0.01 |

(Cpd-1) Surfactant
a 7:3 mixture (weight ratio) of:

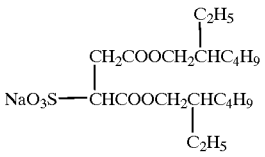

and

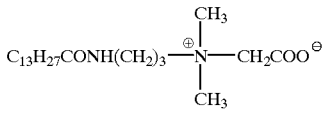

(Cpd-2) Preservative
Preservative

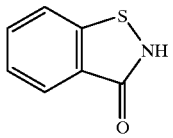

(Cpd-3)

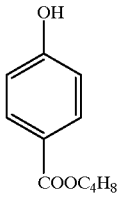

(Cpd-4) Preservative

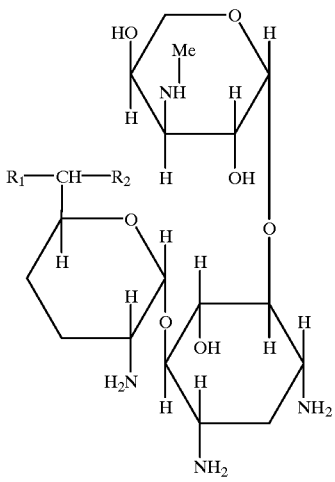

| | $R_1$ | $R_2$ |
|---|---|---|
| a | —Me | —NHMe |
| b | —Me | —$NH_2$ |
| c | —H | —$NH_2$ |
| d | —H | NHMe |

a mixture of a, b, c, d in a ratio of 1:1:1:1

-continued
(Cpd-5) Preservative
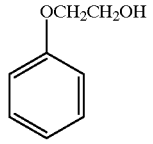
(Cpd-7) Color Image Stabilizer
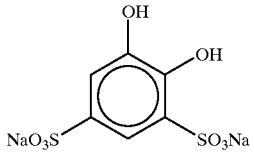
(Cpd-8) Wettability Improving Agent
number average molecular weight: 1,000,000
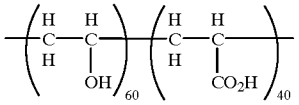
(Cpd-9) Wettability Improving Agent
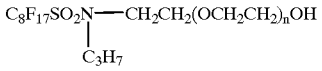
n = 15
(Cpd-10) Wettability Improving Agent
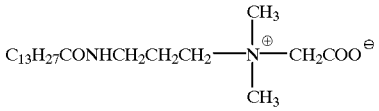
(Cpd-6) Color Mixing Preventing Agent
(1)
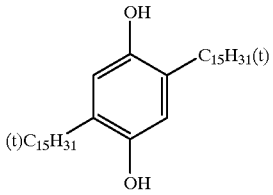
(2)
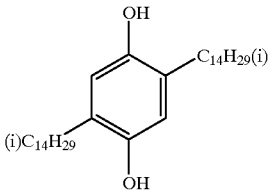
(3)
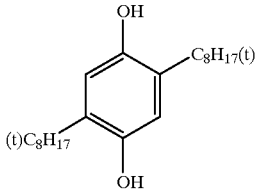
(1):(2):(3) = 1:1:1 mixture (weight ratio)
(Solv-2) Solvent
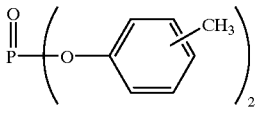
(Solv-1) Solvent
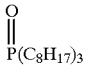
(Solv-3) Solvent
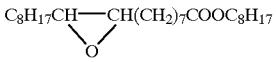

-continued (Solv-4) Solvent

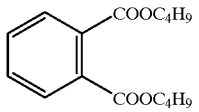

(Solv-5) Solvent

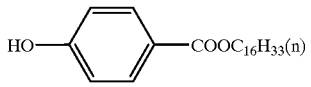

(Solv-6) Solvent
$C_8H_{17}OCO—(CH_2)_8—COOC_8H_{17}$
(UV-1) Ultraviolet Light Absorbing Agent (1)

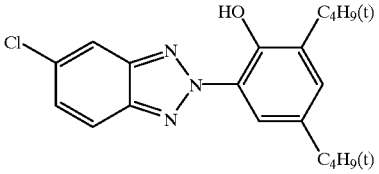

(2)

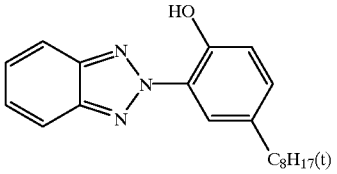

(3)

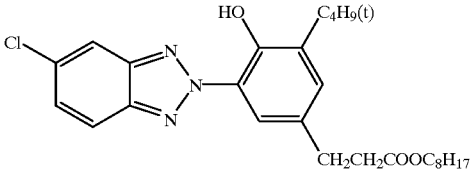

(4)

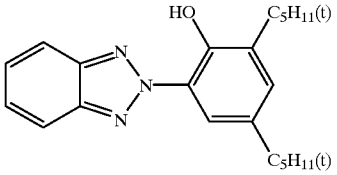

(5)

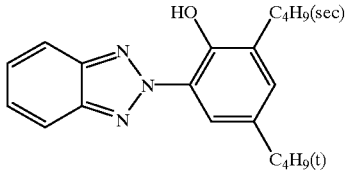

(1):(2):(3):(4):(5) = 1:2:2:3:1 mixture (weight ratio)
Fluorescent Whitening Agent (II)

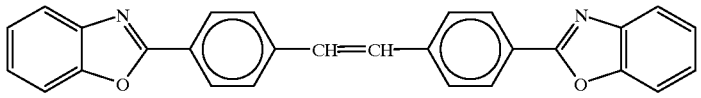

Fluorescent Whitening Agent (I)

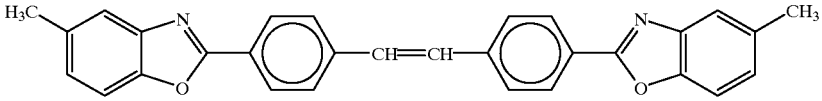

II/I=20/80 (weight ratio)
contained amount: 15 mg/m$^2$
amount with respect to polyethylene: 0.05 wt %

Developing Solution (Alkaline Activating Solution)

| | |
|---|---|
| water | 600 ml |
| KOH | 14 g |
| KCl | 2.5 g |
| benzotriazole | 0.02 g |

-continued

| | |
|---|---|
| hydroxyethylidene-1,1-diphosphoric acid (30%) | 4 ml |
| add water until entire amount of solution is 1000 ml | |
| do not adjust pH | |

Bleaching-Fixing Solution

| | |
|---|---|
| water | 600 ml |
| ammonium thiosulfate (700 g/liter) | 93 ml |
| ammonium sulfite | 40 g |
| iron (III) ammonium ethylenediamine tetraacetate | 55 g |
| ethylenediamine tetraacetate | 2 g |

-continued

| | |
|---|---|
| nitric acid (67%) | 30 g |
| add water until entire amount of solution is 1000 ml | |
| pH (25° C./with acetic acid and ammonia): 5.8 | |
| Rinsing Solution | |
| chlorinated sodium isocyanurate | 0.02 g |
| deionized water (conductivity: 5 μS/cm or less) | 1000 ml |
| pH: 6.5 | |

Figure 3:
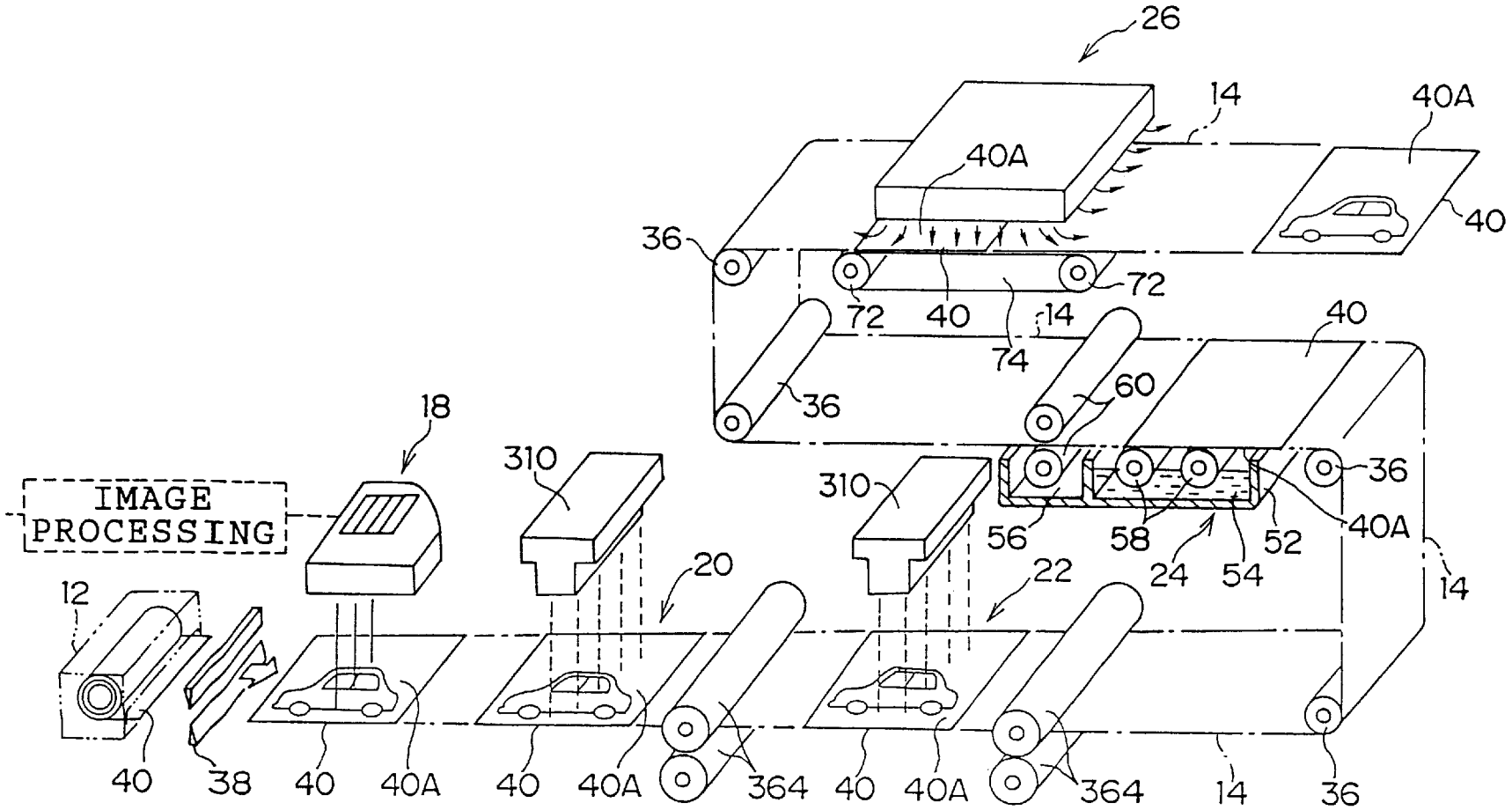
FIG. 3 is a schematic structural perspective view illustrating a flow of processing steps of the image forming device relating to the embodiment of the present invention.

Next, the operation and method of use of the image forming apparatus structured as described above will be explained with reference to FIGS. 1 and 3. First, an image original is input by a scanner or the like, image processing is carried out, and preparations for operation at the exposure section 18 are made.

At the exposure section 18, a desired original image is exposed onto the emulsion surface 40A, which is one surface of the photosensitive material 40, and the photosensitive material 40 is fed to the developing section 20. At the developing section 20, developing solution is applied onto the emulsion surface 40A of the photosensitive material 40 by the coating device 310, which is a processing solution applying device, in an amount of 50 ml/m$^2$, and developing processing is carried out for 30 seconds at a predetermined temperature (40° C.). After the excess developing solution has been squeezed out by the rollers 364, the photosensitive material 40 is sent into the bleaching-fixing section 22. In the bleaching-fixing section 22, bleaching-fixing solution is applied by the coating device 310, which is the processing solution applying device, onto the emulsion surface 40A of the photosensitive material 40. After bleaching-fixing processing is carried out for 45 seconds at a predetermined temperature (35° C.), the excess bleaching-fixing solution is squeezed out by the rollers 364, and the photosensitive material 40 is fed to the after-processing section 24.

Next, in the after-processing section 24, processing solution at 35° C. is applied to the emulsion surface 40A of the photosensitive material 40 by the processing solution rollers 58 at the respective cascades 52, the residual solutions on the emulsion surface 40A are wiped off, and then, the residual solutions adhering to the emulsion surface 40A of the photosensitive material 40 are squeezed out by the squeeze rollers 60. This operation is carried out successively for 90 seconds while the photosensitive material 40 is being conveyed linearly from the first cascade 52A to the eighth cascade 52H. The concentration of the residual solutions is quickly reduced to even less than standard, and washing is completed. Thereafter, the photosensitive material 40 is fed to the drying section 26.

At the drying section 26, the emulsion surface 40A, which is the surface at one side of the photosensitive material 40 which has been made wet by the washing solution, is dried at 70 to 80° C. for 60 seconds so that an image is formed, and the photosensitive material 40 is discharged as a finished product from the discharge opening 16 onto a receiving tray 10A. The operation for controlling the series of image forming processes is thus completed.

The operations of the respective processes described above are carried out only on the emulsion surface 40A which is one surface of the photosensitive material 40. Thus, as compared with conventional methods such as immersion in which both the emulsion surface 40A of the photosensitive material 40 and the surface opposite thereto are made wet, the processing solutions are applied to only the emulsion surface 40A of the photosensitive material 40 and it is only necessary to wash one of the surfaces of the photosensitive material 40. Thus, the amount of processing solutions applied to the photosensitive material 40 is reduced, and deterioration of the processing solutions is suppressed. Further, it suffices to only dry the emulsion surface 40A of the photosensitive material 40. Therefore, as compared with drying the entire front surface and the entire reverse surface of the photosensitive material 40, the amount of time required for drying can be shortened, and thus, the processing time can be greatly shortened.

Further, when the image forming device is not used for a long, fixed period of time, or at predetermined times each day such as when the image forming device begins to be used, the squeeze rollers 60 and the processing solution rollers 58 of the after-processing section 24 are washed automatically by the washing device.

In addition, when the developing solution tank 28, the bleaching-fixing solution tank 30, and the washing water tank 32 become empty, the corresponding predetermined solution is always replenished thereto. Further, when the waste solution tank 34 becomes full, the waste solution stored therein is always disposed of.

It is possible to form the route of the above-described processing operations of exposure, development, bleaching-fixing, washing, drying and the like in plural rows in the image forming device.

In the structure of the present embodiment, a conventional immersion method is not used in the image forming device. Thus, there is no need for large processing solution tanks in which the photosensitive material is immersed. The conveying path for immersing the photosensitive material in the processing solutions in the processing solution tanks is pulled back from the space above and outside of the processing solutions in the processing solution tanks to within the processing solutions therebeneath, and there is no need to provide a long, vertical conveying path for pulling the photosensitive material out again to the space above and outside of the processing solutions. As a result, the conveying path of the photosensitive material can be made horizontal and does not extend up and down in the vertical direction. Further, in the structure of the present embodiment, the processing solution is used up and no waste solution remains. Therefore, there is no need for a large waste solution tank. Accordingly, because processing solution tanks for immersion, a large conveying path which extends up and down vertically, and a waste solution tank are all unnecessary, the entire image forming apparatus can be made to have a simpler and more compact structure.

In the present embodiment, washing processing is carried out as the after-processing which follows developing processing and bleaching-fixing processing. The washing processing may be carried out by using water or another rinsing solution. Further, the after-processing may be, other than washing processing, any of various types of processings for stopping the necessary processing developing effect.

The present invention is not limited to the above-described structure, and structures such as those described hereinafter may be employed. As a first example, developing solution may be sprayed by the solution spraying device 312 such that developing processing is carried out, and bleaching-fixing solution may be applied by a processing solution applying means other than the solution spraying device 312 such that bleaching-fixing processing is carried out.

As a second example, developing solution may be sprayed by the solution spraying device 312 such that developing processing is carried out, and bleaching-fixing solution may be applied by the solution spraying device 312 such that bleaching-fixing processing is carried out.

As a third example, developing solution may be sprayed by the solution spraying device 312 such that developing processing is carried out, bleaching-fixing solution may be applied by a processing solution applying means other than the solution spraying device 312 such that bleaching-fixing processing is carried out, and an after-processing may be carried out by applying an after-processing solution by a processing solution applying means other than the solution spraying device 312.

As a fourth example, developing solution may be sprayed by the solution spraying device 312 such that developing processing is carried out, bleaching-fixing solution may be sprayed by the solution spraying device 312 such that bleaching-fixing processing is carried out, and an after-processing may be carried out by applying an after-processing solution by a processing solution applying device other than the solution spraying device 312.

As a fifth example, developing solution may be sprayed by the solution spraying device 312 such that developing processing is carried out, bleaching-fixing solution may be applied by a processing solution applying device other than the solution spraying device 312 so that bleaching-fixing processing is carried out, and an after-processing solution may be sprayed by the solution spraying device 312 to effect the after-processing.

As a sixth example, developing solution may be sprayed by the solution spraying device 312 such that developing processing is carried out, bleaching-fixing solution may be sprayed by the solution spraying device 312 so that bleaching-fixing processing is carried out, and an after-processing solution may be sprayed by the solution spraying device 312 so that an after-processing is carried out.

Known couplers may be used as the dye forming coupler used in the photosensitive material. Examples of such known couplers are disclosed in Japanese Patent Application Laid-Open (JP-A) No. 7-104448, from the 12$^{th}$ column, line 20 to the 39$^{th}$ column, line 49 and from the 87$^{th}$ column, line 40 to the 88$^{th}$ column, line 18; in JP-A-7-77775 from the 62$^{nd}$ column, line 50 to the 64$^{th}$ column, line 11; in JP-A-7-301895 from the 88$^{th}$ column, line 21 to the 89$^{th}$ column, line 46, and from the 31$^{st}$ column, line 34 to the 77$^{th}$ column, line 44; JP-A-62-215272 from page 91, upper right column, line 4 to page 121, upper left column, line 6; JP-A-2-33144 from page 3, upper right column, line 14 to page 18, upper left column, last line, and from page 30, upper right column, line 6 to page 35, lower right column, line 11; and in EP 0355,660A2 on page 4, lines 15–27, from page 5, line 30$^{th}$ to page 28, the final line, on page 45, lines 29–31, and from page 47, line 23 to page 63, line 50.

Any of known color developing agents which can be incorporated in photosensitive materials can be used as the color developing agent in the present invention. Preferable examples are the hydrazine compounds disclosed in JP-A Nos. 8-234388, 9-152686, 9-152693, and 9-160193.

In the present invention, after development (cross-oxidization of silver development/incorporated reducer) of the photosensitive material, desilverization, washing, and stabilizing processings are carried out in accordance with the processing. After the washing or stabilizing processing, processing for color forming enhancement, such as alkali addition or the like, may be carried out. The developing processing of the present invention will be described hereinafter. In the present invention, color developing processing is carried out by incorporating a color developing agent in the photosensitive material, and by effecting processing by an alkaline processing solution which substantially does not contain any color developing agent. One feature of the present invention is that the alkaline processing solution contains substantially no color developing agent. The alkaline processing solution may contain other components (alkalis, halogens, chelating agents and the like). Further, there are cases in which it is preferable for the alkaline processing solution to not include a reducer, in order to maintain the processing stability. In this case, it is preferable that substantially no auxiliary developing agents, hydroxyamines, sulfites or the like are included. Here, "substantially includes no" is intended to mean preferably 0.5 mmol/liter or less, and more preferably 0.1 mmol/liter or less. In particular, it is preferable that absolutely none is contained. The pH of the processing solution used in the present invention is preferably 9–14, and is particularly preferably 10–13. After development, an intensification processing may be carried out. From an environmental standpoint, the compound that carries out intensification is preferably hydrogen peroxide or a compound which releases hydrogen peroxide. Preferable examples of compounds which release hydrogen peroxide are perboric acid and percarbonic acid. Among these, hydrogen peroxide is especially preferable. The added amounts of these compounds are preferably 0.005 to 1 mol/liter, more preferably 0.01 to 0.5 mol/liter, and particularly preferably 0.02 to 0.25 mol/liter.

In order to improve the wettability with respect to the surface of the photosensitive material, the processing solutions of the present invention may contain organic solvents such as methanol, ethanol, isopropyl alcohol, and the like.

Specifics of the compositions of the developing solution (preferably, an activator solution), the desilverization solution (the bleaching/fixing solution), and the washing and stabilizing solutions are disclosed in Research Disclosure, Item 36544 (September 1994), pages 536–541, in JP-A-8-234388, and the like, and various solutions can be used in accordance with these disclosures. Several examples thereof are listed below.

| Type of Processing Solution | Page |
|---|---|
| fogging preventing agent | 537 |
| chelating agent | 537, right column |
| buffering agent | 537, right column |
| surfactant | 538, left column and 539, left column |
| bleaching agent | 538 |
| bleaching accelerator | 538, right column to 539, left column |
| chelating agent for bleaching | 539, left column |
| rehalogenizing agent | 539, left column |
| fixing agent | 539, right column |
| preservative for fixing agent | 539, right column |
| chelating agent for fixing | 540, left column |
| surfactant for stabilizing | 540, left side |
| scum preventing agent for stabilizing | 540, right side |
| chelating agent for stabilizing | 540, right side |
| antifungal/antibacterial agent | 540, right side |
| color image stabilizer | 540, right side |

The present invention is not limited to the above-described structures, and any of various structures falling within the scope of the present invention may be employed.

In the above-described processing solution applying device relating to the present invention, processing with solutions can be carried out quickly and by using small amounts of the processing solutions.

What is claimed is:

1. An image forming device which, after exposing a silver halide photographic photosensitive material, subjects the silver halide photographic photosensitive material to at least developing and bleaching-fixing processings so as to form an image on the silver halide photographic photosensitive material, the silver halide photographic photosensitive material having, on a support, one or more photographic structural layers, at least one of the photographic structural layers containing at least one color developing agent and at least one dye forming coupler, said image forming device comprising:

a processing solution applying device which applies a processing solution for developing onto only a surface of the silver halide photographic photosensitive material at which surface the one or more photographic structural layers are provided, wherein the processing solution applying device has a plurality of nozzle holes, and the processing solution is sprayed simultaneously from the plurality of nozzle holes to be applied only to the surface of the silver halide photographic photosensitive material at which surface the one or more photographic layers are provided, in an amount which is used up for the processing.

2. An image forming device according to claim 1, wherein the processing solution for developing, which is applied onto only the surface of the silver halide photographic photosensitive material at which surface the one or more photographic structural layers are provided, is an alkaline activating solution.

3. The image forming device according to claim 1, wherein the plurality of nozzle holes are arranged so as to be distributed along an entire transverse direction width of the silver halide photographic photosensitive material, the nozzle holes and the silver halide photographic photosensitive material are moved relative to one another.

4. An image forming device which, after exposing a silver halide photographic photosensitive material, subjects the silver halide photographic photosensitive material to at least developing and bleaching-fixing processings so as to form an image on the silver halide photographic photosensitive material, the silver halide photographic photosensitive material having, on a support, one or more photographic structural layers, at least one of the photographic structural layers containing at least one color developing agent and at least one dye forming coupler, said image forming device comprising:

a processing solution applying device which applies a processing solution for bleaching-fixing onto only a surface of the silver halide photographic photosensitive material at which surface the one or more photographic structural layers are provided, wherein the processing solution applying device has a plurality of nozzle holes, and the processing solution is sprayed simultaneously from the plurality of nozzle holes to be applied only to the surface of the silver halide photographic photosensitive material at which surface the one or more photographic layers are provided, in an amount which is used up for the processing.

5. The image forming device according to claim 4, wherein the plurality of nozzle holes are arranged so as to be distributed along an entire transverse direction width of the silver halide photographic photosensitive material, the nozzle holes and the silver halide photographic photosensitive material are moved relative to one another.

6. The image forming device according to claim 4, wherein the plurality of nozzle holes are arranged so as to be distributed along an entire transverse direction width of the silver halide photographic photosensitive material, the nozzle holes and the silver halide photographic photosensitive material are moved relative to one another.

7. An image forming device which forms an image on a silver halide photographic photosensitive material which has, on a support, one or more photographic structural layers, at least one of the photographic structural layers containing at least one color developing agent and at least one dye forming coupler, said image forming device comprising:

a developing processing solution applying device which applies a processing solution for developing onto only a surface of the silver halide photographic photosensitive material at which surface the one or more photographic structural layers are provided;

a bleaching-fixing processing solution applying device which applies a processing solution for bleaching-fixing onto only the surface of the silver halide photographic photosensitive material at which surface the one or more photographic structural layers are provided;

an after-processing solution applying device which applies a processing solution for an after-processing onto only the surface of the silver halide photographic photosensitive material at which surface the one or more photographic structural layers are provided; and wherein each of the processing solution applying devices has a plurality of nozzle holes, and the processing solution is sprayed simultaneously from the plurality of nozzle holes of the developing processing solution applying device, simultaneously from the plurality of nozzle holes of the bleaching-fixing processing solution applying device, and simultaneously from the plurality of nozzle holes of the after-processing solution applying device to be applied only to the surface of the silver halide photographic photosensitive material at which surface the one or more photographic layers are provided, in an amount which is used up for the processing.

8. The image forming device according to claim 7, wherein the processing solution for developing, which is applied onto only the surface of the silver halide photographic photosensitive material at which surface the one or more photographic structural layers are provided, is an alkaline activating solution.

9. The image forming device according to claim 7, wherein the plurality of nozzle holes are arranged so as to be distributed along an entire transverse direction width of the silver halide photographic photosensitive material, the nozzle holes and the silver halide photographic photosensitive material are moved relative to one another.

10. The image forming device according to claim 7, wherein the plurality of nozzle holes are arranged so as to be distributed along an entire transverse direction width of the silver halide photographic photosensitive material, the nozzle holes and the silver halide photographic photosensitive material are moved relative to one another.

* * * * *